US011963575B2

(12) United States Patent
Hollinger

(10) Patent No.: US 11,963,575 B2
(45) **Date of Patent: *Apr. 23, 2024**

(54) SOLE STRUCTURE FOR ARTICLE OF FOOTWEAR

(71) Applicant: NIKE, Inc., Beaverton, OR (US)

(72) Inventor: Kevin Hollinger, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/934,865

(22) Filed: Sep. 23, 2022

(65) Prior Publication Data

US 2023/0013206 A1 Jan. 19, 2023

Related U.S. Application Data

(63) Continuation of application No. 16/921,851, filed on Jul. 6, 2020, now Pat. No. 11,452,333, which is a (Continued)

(51) Int. Cl.
*A43B 13/16* (2006.01)
*A43B 3/00* (2022.01)

(Continued)

(52) U.S. Cl.
CPC ..... *A43B 13/16* (2013.01); *A43B 3/0068* (2013.01); *A43B 5/00* (2013.01); *A43B 13/02* (2013.01);

(Continued)

(58) Field of Classification Search
CPC ..... A43B 13/16; A43B 3/0068; A43B 13/12

(Continued)

(56) References Cited

U.S. PATENT DOCUMENTS 4,564,966 A * 1/1986 Chen ..... A43B 13/04 36/31
5,224,279 A * 7/1993 Agnew ..... A43B 13/223 36/31

(Continued)

FOREIGN PATENT DOCUMENTS

CN 101188955 A 5/2008
CN 104486960 A 4/2015

(Continued)

OTHER PUBLICATIONS

European Patent Office, International Search Report and Written Opinion for PCT Application No. PCT/US2019/014469, dated May 28, 2019.

(Continued)

*Primary Examiner* — Timothy K Trieu
(74) *Attorney, Agent, or Firm* — Honigman LLP; Matthew H. Szalach; Jonathan P. O'Brien

(57) ABSTRACT

A sole structure includes a main body formed of a first material and at least one insert formed of a second material. The main body defines first portion of a ground-engaging surface including a first channel defined by a first segment extending along a first axis and a second segment extending along a second axis transverse to the first axis. The one or more inserts are received in sockets formed in the main body. The at least one insert defines a second portion of the ground-engaging surface and has a second channel including a third segment extending along a third axis parallel to the first axis and a fourth segment extending along a fourth axis transverse to the third axis and substantially parallel to the second axis. One of the first channel and the second channel defines an interface between the main body and the insert.

20 Claims, 23 Drawing Sheets

Related U.S. Application Data continuation of application No. 15/878,095, filed on Jan. 23, 2018, now Pat. No. 10,716,359.

(51) Int. Cl.

| | |
|---|---|
| ***A43B 5/00*** | (2022.01) |
| ***A43B 13/02*** | (2022.01) |
| ***A43B 13/04*** | (2006.01) |
| ***A43B 13/14*** | (2006.01) |
| ***A43B 13/22*** | (2006.01) |

(52) U.S. Cl.

CPC ..... *A43B 13/04* (2013.01); *A43B 13/145* (2013.01); *A43B 13/22* (2013.01); *A43B 13/223* (2013.01)

(58) Field of Classification Search

USPC ..... 36/31

See application file for complete search history.

(56) References Cited

U.S. PATENT DOCUMENTS

| | | | | |
|---|---|---|---|---|
| 10,342,291 | B2 * | 7/2019 | Avar | A43B 13/22 |
| 10,716,359 | B2 * | 7/2020 | Hollinger | A43B 13/04 |
| 2002/0017038 | A1 | 2/2002 | Umezawa | |
| 2005/0262739 | A1 | 12/2005 | McDonald et al. | |
| 2010/0299965 | A1 * | 12/2010 | Avar | A43B 5/06 36/102 |
| 2014/0223779 | A1 * | 8/2014 | Elder | A43B 23/0245 36/83 |
| 2015/0128455 | A1 * | 5/2015 | Lubart | A43C 15/00 36/25 R |
| 2015/0290892 | A1 | 10/2015 | Wan et al. | |
| 2016/0219975 | A1 * | 8/2016 | Wright | A43B 13/122 |
| 2016/0324260 | A1 | 11/2016 | Guyan | |
| 2017/0119091 | A1 | 5/2017 | Bischoff et al. | |
| 2017/0267845 | A1 | 9/2017 | Baghdadi | |
| 2017/0267846 | A1 | 9/2017 | Baghdadi | |
| 2017/0267847 | A1 | 9/2017 | Baghdadi | |
| 2017/0267848 | A1 | 9/2017 | Baghdadi | |
| 2017/0267849 | A1 | 9/2017 | Baghdadi | |
| 2017/0267850 | A1 | 9/2017 | Baghdadi | |

FOREIGN PATENT DOCUMENTS

| | | | |
|---|---|---|---|
| CN | 205456450 | U | 8/2016 |
| GB | 2099283 | A | 12/1982 |
| KR | 19980013057 | U | 6/1998 |
| KR | 20150019043 | A | 2/2015 |

OTHER PUBLICATIONS

USPTO, Non-Final Office Action for U.S. Appl. No. 15/878,095, dated Nov. 14, 2019.

China Patent Office, Office Action dated May 21, 2021 for app No. 202010795003.4.

* cited by examiner

SOLE STRUCTURE FOR ARTICLE OF FOOTWEAR

CROSS REFERENCE TO RELATED APPLICATION

This application is a continuation of U.S. application Ser. No. 16/921,851, filed Jul. 6, 2020, which is a continuation of U.S. application Ser. No. 15/878,095, filed Jan. 23, 2018, the contents of which are incorporated herein by reference in their entirety.

FIELD

The present disclosure relates generally to sole structures for articles of footwear and more particularly to sole structures incorporating a composite ground-contacting surface.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed using materials and geometries that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
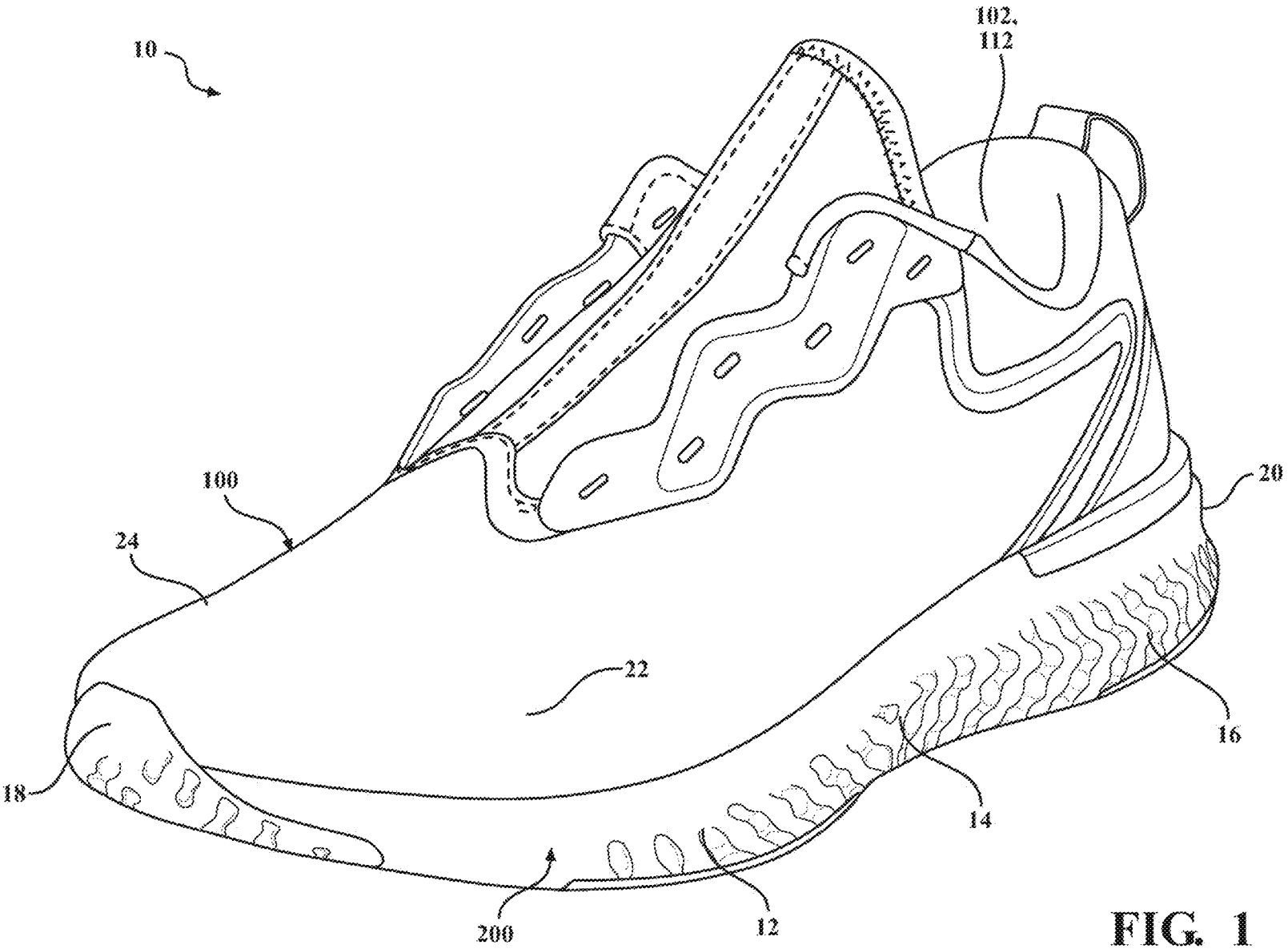
FIG. 1 is a side perspective view of an article of footwear in accordance with principles of the present disclosure.
Figure 2:
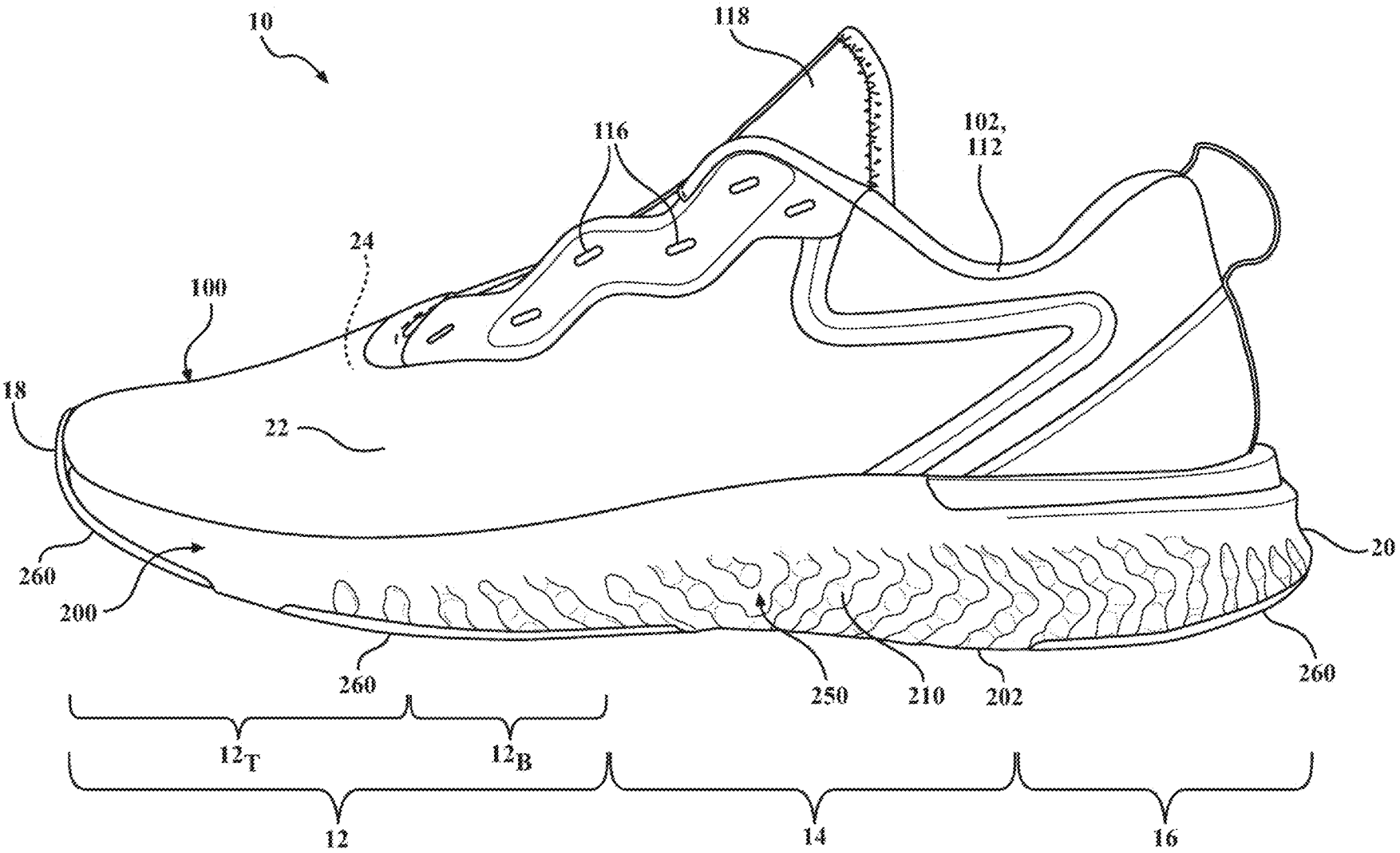
FIG. 2 is a lateral-side elevation view of the article of footwear of FIG. 1.
Figure 3:
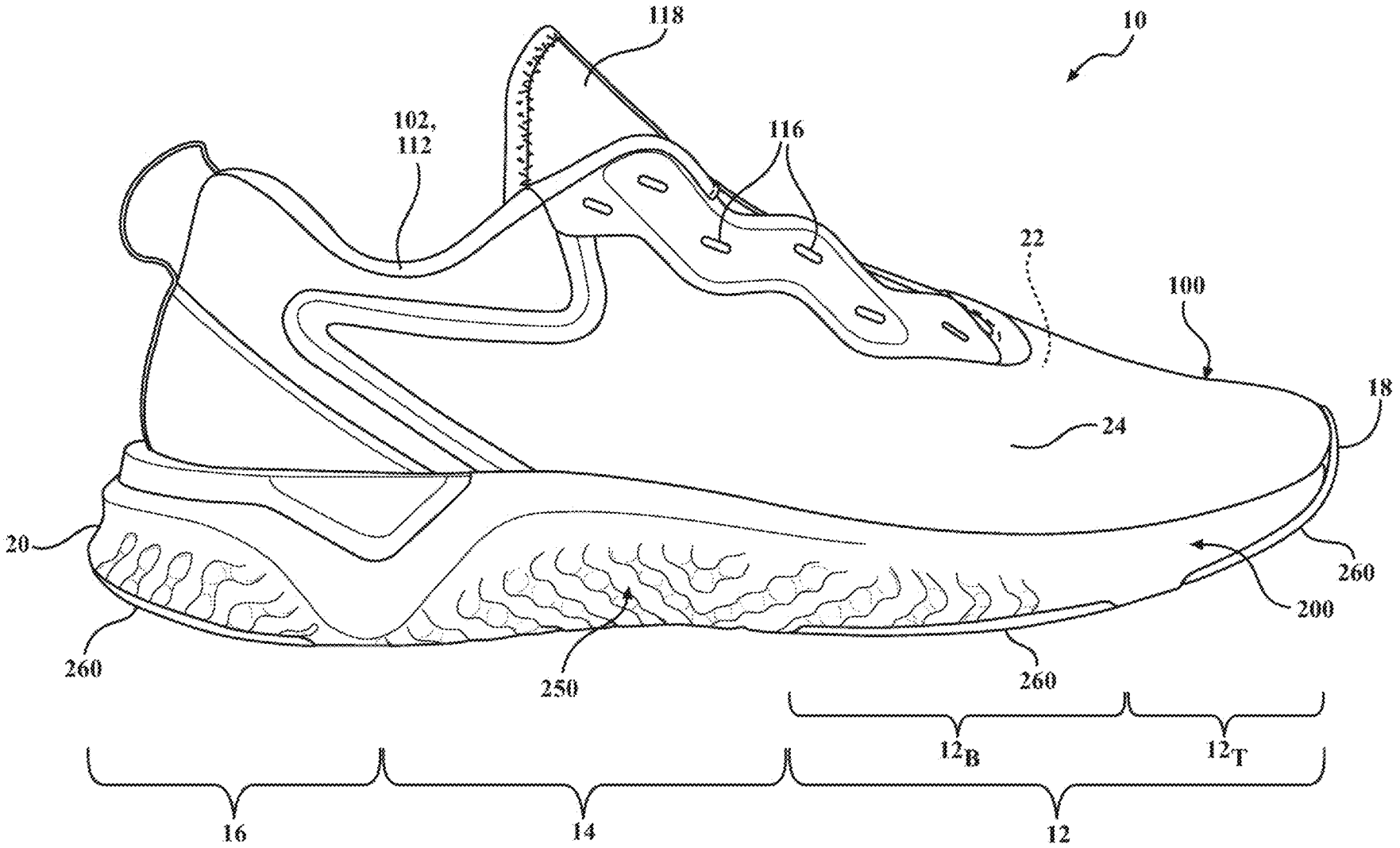
FIG. 3 is a medial-side elevation view of the article of footwear of FIG. 1.
Figure 5:
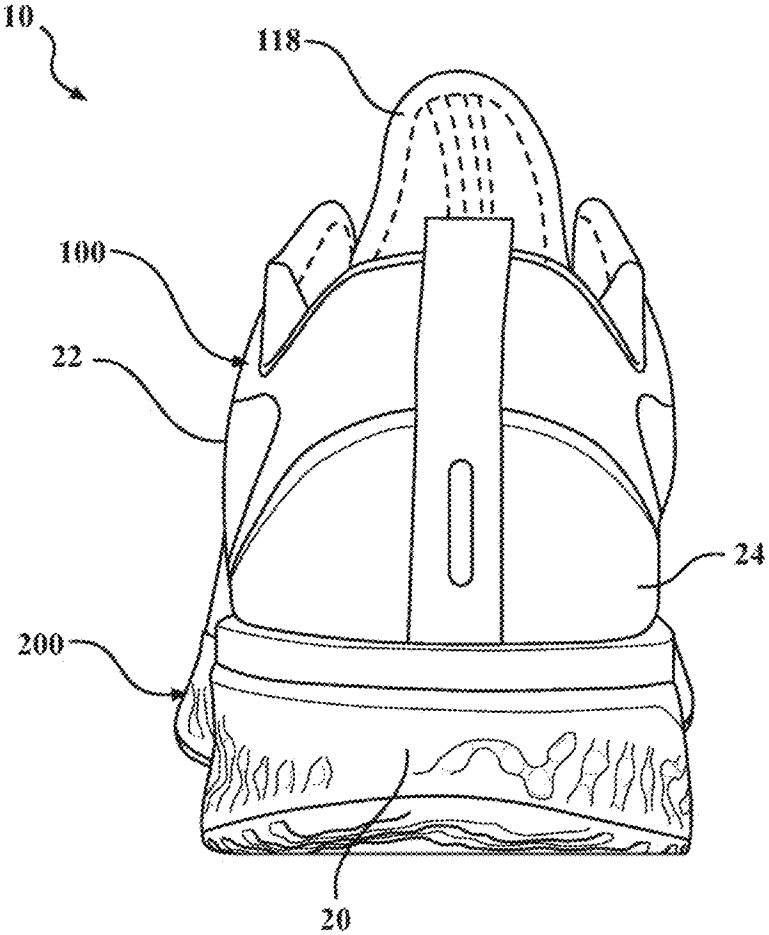
FIG. 5 is a rear elevation view of the article of footwear of FIG. 1.
Figure 4:
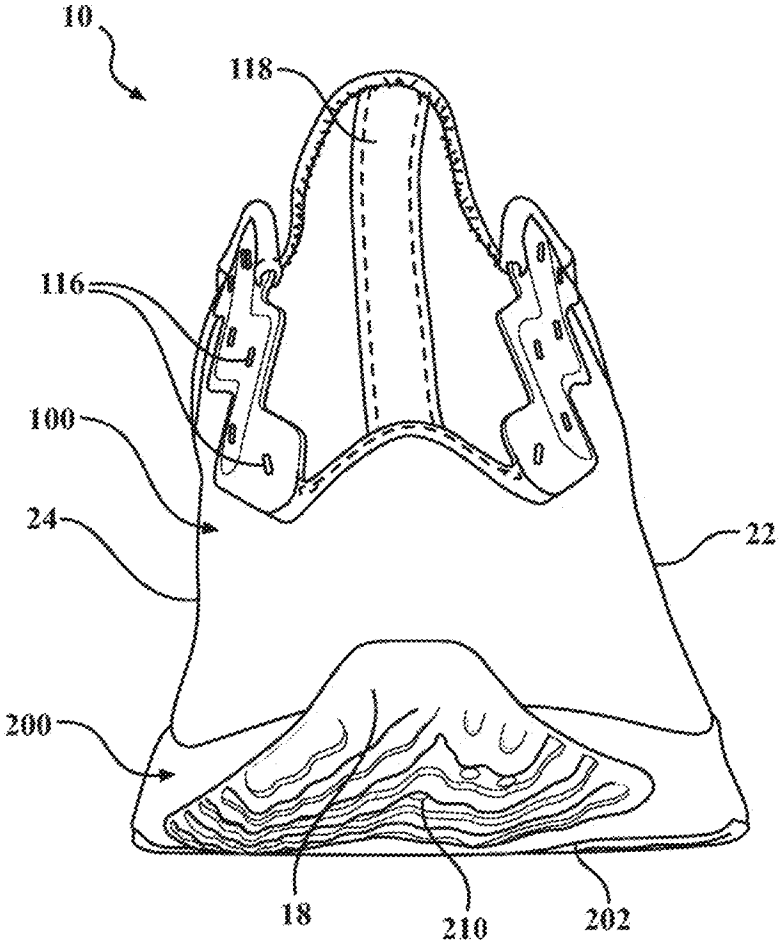
FIG. 4 is a front elevation view of the article of footwear of FIG. 1.
Figure 6:
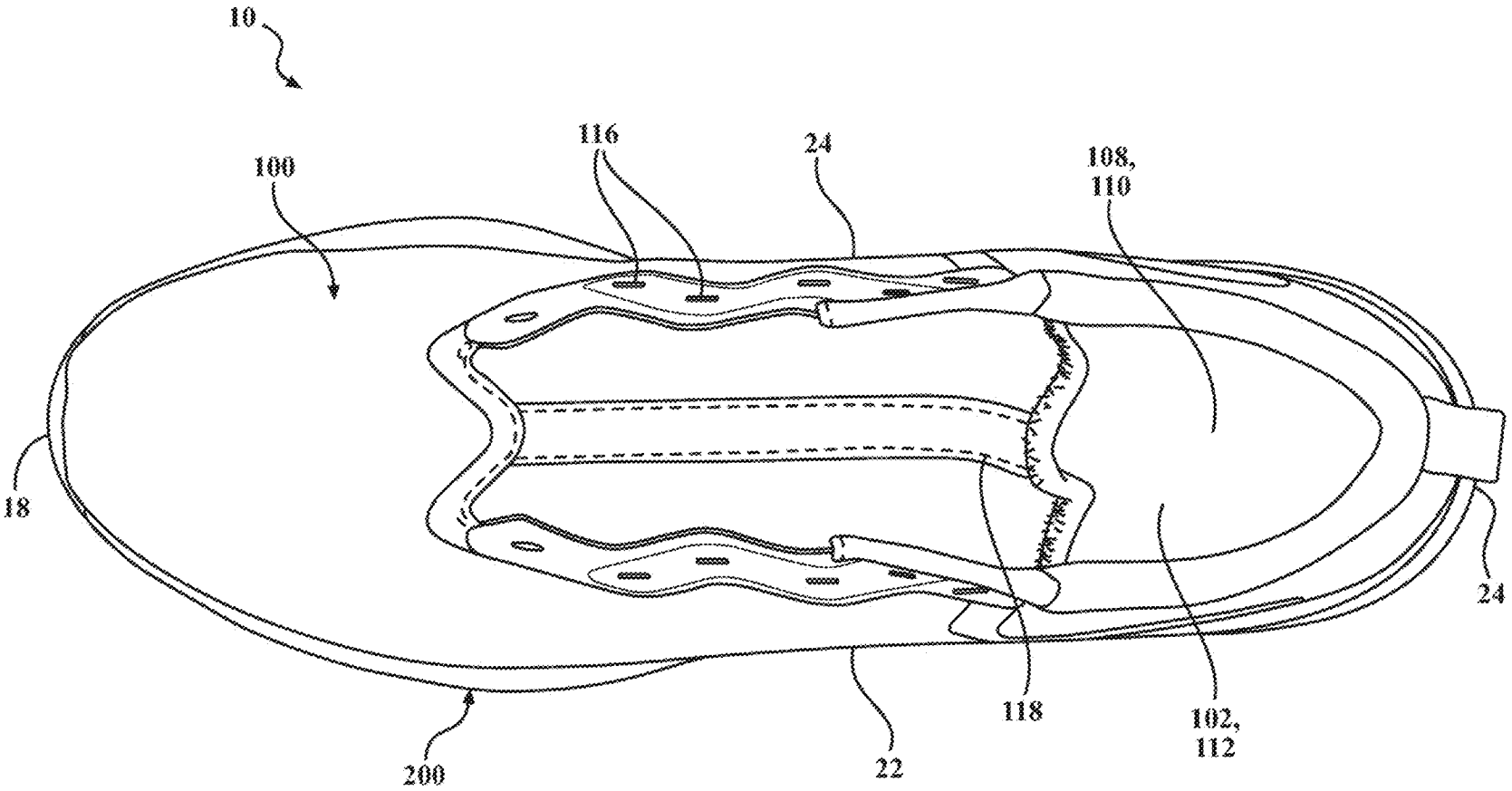
FIG. 6 is a top view of the article of footwear of FIG. 1.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a main body formed of a first material and defining a first portion of a ground-engaging surface. The main body includes a first channel defined by a first segment extending along a first axis and a second segment extending along a second axis transverse to the first axis. The sole structure also includes at least one insert formed of a second material and received by the main body. The at least one insert defines a second portion of the ground-engaging surface that is flush with the first region of the ground-engaging surface and has a second channel including a third segment extending along a third axis parallel to the first axis and a fourth segment extending along a fourth axis transverse to the third axis and substantially parallel to the second axis. One of the first channel and the second channel defines an interface between the main body and the insert.

Implementations of the disclosure may include one or more of the following optional features. In some implementations, the at least one insert includes an anterior insert defining at least a portion of a forefoot region of the ground-engaging surface, and a posterior insert defining at least a portion of a heel region of the ground-engaging surface. Here, the anterior insert may include the second channel and the posterior insert may include a third channel having a fifth segment extending along a fifth axis substantially parallel to the first axis and a sixth segment extending along a sixth axis transverse to the fifth axis and substantially parallel to the second axis, the third channel defining an interface between the main body and the posterior insert. Additionally or alternatively, the main body may define at least a portion of a midfoot region of the sole structure and may separate the anterior insert from the posterior insert.

In some examples, the main body is formed of a foam material and the at least one insert is formed of a rubber material. The main body may define at least one side surface of the sole structure, a portion of the first channel of the main body extending onto the side surface. Here, the at least one side surface of the sole structure may include a lateral side surface having a first portion of the first channel formed therein and a medial side surface having a second portion of the second channel formed therein.

In some configurations, the main body includes a socket defined by a recessed surface offset from the ground-engaging surface and a sidewall extending between the ground-engaging surface and the recessed surface and intersecting the at least one side surface to define a notch. In this configuration, the insert is received by the socket, a first portion of a peripheral surface of the insert mating with the sidewall of the socket and a second portion of the peripheral surface of the insert being disposed in the notch and flush with the at least one side surface. In some examples, the first region of the ground-engaging surface is continuous and flush with the second region of the ground-engaging surface.

Another aspect of the disclosure provides a sole structure for an article of footwear. The sole structure includes a main body defining a first region of a ground-engaging surface and at least one side surface extending from the ground-engaging surface. The sole structure also includes at least one insert received by the main body, which defines a second region of the ground-engaging surface. The sole structure further includes a first channel defined by a first plurality of segments including a first segment extending from a first node to a second node along a first axis, a second segment extending from a third node to a fourth node along a second axis transverse to the first axis, and a third segment extending from a fifth node to a sixth node along a third axis transverse to the second axis and substantially parallel to the first axis.

Implementations of the disclosure may include one of more of the following optional features. In some implementations, the first segment is formed along a first side surface, the second segment is formed in the first region of the ground-engaging surface, and the third segment is formed along a second side surface.

In some examples, the sole structure includes a second channel defined by a second plurality of segments including a fourth segment extending from a seventh node to an eighth node along a fourth axis substantially parallel to the first axis and a fifth segment extending from a ninth node to a tenth node along a fifth axis substantially parallel to the second axis. Here, the first channel may be formed only in the main body of the sole structure and the second channel may be formed only in the insert of the sole structure. The insert may include an aperture through at least one of the nodes of the channel, such that the main body is exposed through the aperture. A first portion of the first channel may be formed in the main body and a second portion of the first channel is formed in the insert. At least one of the segments may include an intermediate node. Here, widths of each of the first channel and the second channel may be variable in a direction along at least one of the axes.

In some configurations, the second node and the third node define a first common node and the fourth node and the fifth node define a second common node, such that the first segment, the second segment, and the third segment are serially connected. Alternatively, the second node, the third node, and the fifth node may define a common node such that the second segment and the third segment define first and second sub-channels, respectively.

Figure 14A:
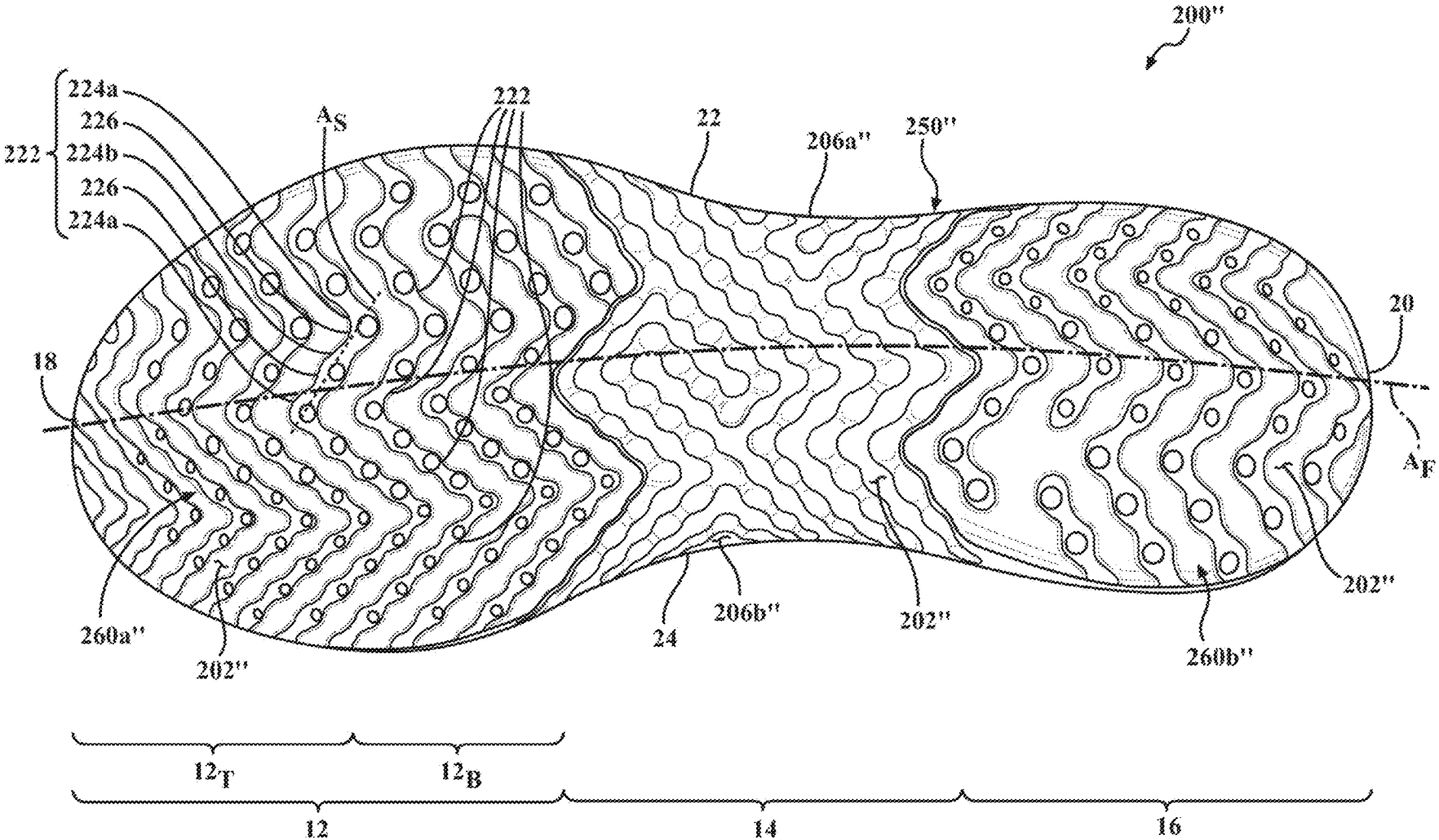
FIGS. 14A-14C are bottom views of the sole structure of FIG. 13.
Figure 20A:
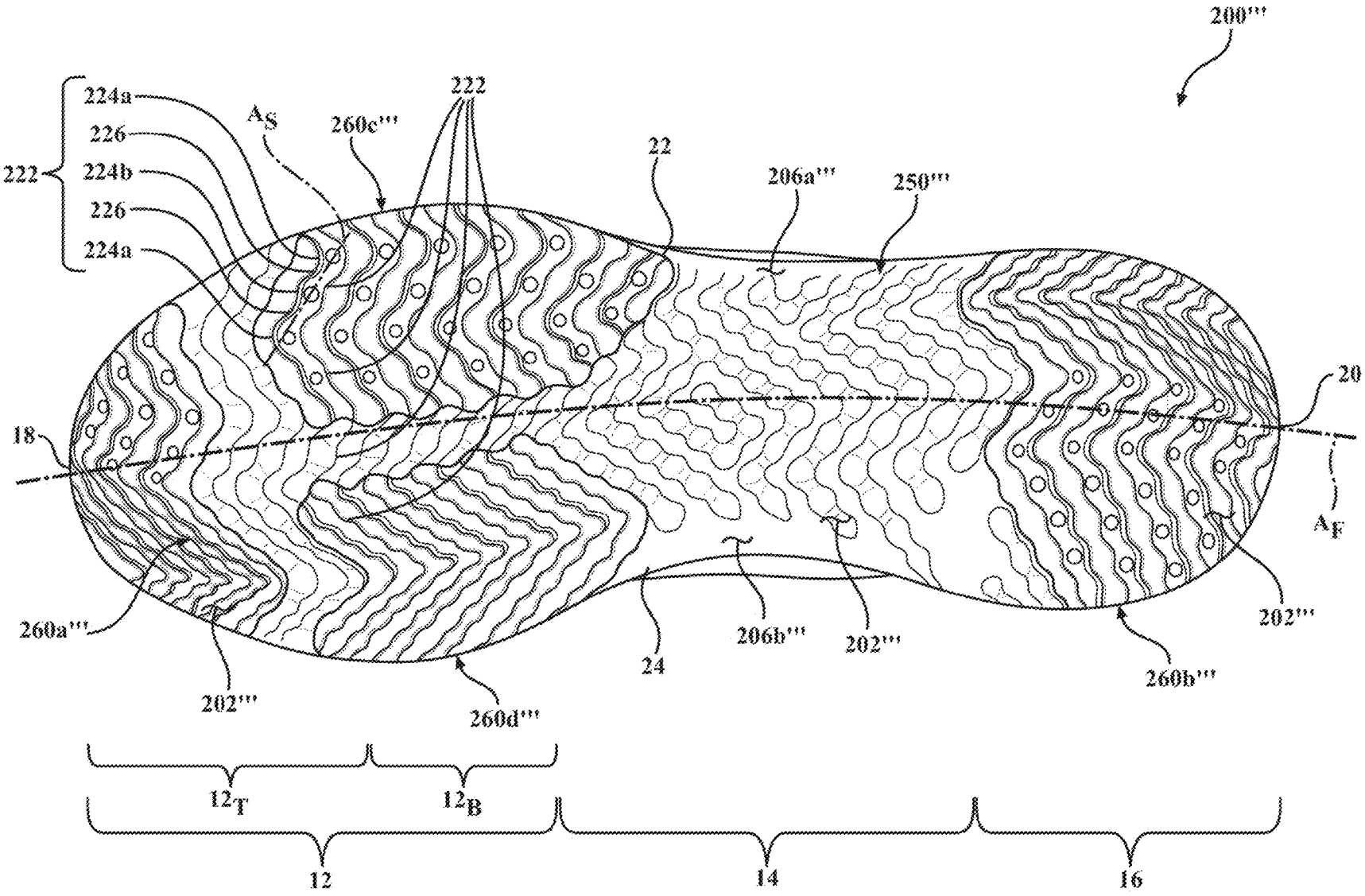
FIGS. 20A-20C are bottom views of the sole structure of FIG. 19.

Referring to FIGS. 1-6, an article of footwear 10 includes an upper 100 and sole structure 200. The article of footwear 10 may be divided into one or more regions. The regions may include a forefoot region 12, a mid-foot region 14, and a heel region 16. The forefoot region 12 may be subdivided into a toe portion 12T corresponding with phalanges and a ball region 12B associated with metatarsal bones of a foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis AF of the footwear 10 extends along a length of the footwear 10 from the anterior end 18 to the posterior end 20, and generally divides the footwear 10 into a lateral region 22 and a medial region 24. Accordingly, the lateral region 22 and the medial region 24 respectively correspond with opposite sides of the footwear 10 and extend through the regions 12, 14, 16. As shown in FIGS. 8, 14, and 20, the longitudinal axis AF of the footwear may be arcuate in shape, such that the longitudinal axis AF is substantially centrally located between the lateral side 22 and the medial side 24 along the length of the footwear 10.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, the upper 100 includes a strobel (not shown) having a bottom surface opposing the sole structure 200 and an opposing top surface defining a footbed 108 of the interior void 102. Stitching or adhesives may secure the strobel to the upper 100. The footbed 108 may be contoured to conform to a profile of the bottom surface (e.g., plantar) of the foot. Optionally, the upper 100 may also incorporate additional layers such as an insole 110 or sockliner that may be disposed upon the strobel and reside within the interior void 102 of the upper 100 to receive a plantar surface of the foot to enhance the comfort of the article of footwear 10. An ankle opening 112 in the heel region 16 may provide access to the interior void 102. For example, the ankle opening 112 may receive a foot to secure the foot within the void 102 and facilitate entry and removal of the foot from and to the interior void 102.

In some examples, one or more fasteners (not shown) extend along the upper 100 to adjust a fit of the interior void 102 around the foot and to accommodate entry and removal of the foot therefrom. The upper 100 may include apertures 116 such as eyelets and/or other engagement features such as fabric or mesh loops that receive the fasteners. The fasteners may include laces, straps, cords, hook-and-loop, or any other suitable type of fastener. The upper 100 may include a tongue portion 118 that extends between the interior void 102 and the fasteners.

With reference to FIGS. 7-24, several alternative implementations of a sole structure 200 according to the instant disclosure are provided. In view of the substantial similarities in structure and function of the components associated with each of the implementations, like reference numerals are used hereinafter and in the drawings to identify common components having the same design. Like reference numerals containing letter extensions are used to identify variations of common components within an implementation of the sole structure 200, while reference numerals containing prime symbols (') are used to identify examples of common components that have been modified between implementations and reference numerals containing subscripts are used to identify sub-components of a parent component. Accordingly, reference to components using numerals not including letter extensions, prime symbols, or subscripts is understood to collectively refer to all variations of a common component including like reference numerals, including those examples having letter extensions, prime symbols, and/or subscripts.

With reference to FIGS. 7-24, the sole structure 200, 200'-200''' includes a ground-engaging surface 202, 202'-202''' configured to interface with a ground surface when the article of footwear 10 is worn by a user. The sole structure 200 is further defined by an upper surface 204, which is formed on an opposite side of the sole structure 200 from the ground-engaging surface 202 and is configured to oppose the upper, thereby providing a foot-support surface. A side surface 206, 206'-206''' extends between the ground-engaging surface 202 and the upper surface 204, and defines an outer periphery of the sole structure 200. Although the illustrated sole structure 200 includes a substantially continuous, contoured side surface 206 extending around the entire periphery of the sole structure 200, it may be defined as comprising a lateral side surface 206*a*, 206*a'*-206*a'''* extending substantially along the lateral side 22 of the sole structure 200, a medial side surface 206*b*, 206*b'*-206*b'''* extending substantially along the medial side 24 of the sole structure 200, an anterior side surface 206*c*, 206'-206''' extending around the forefoot region 12 between the lateral side surface 206*a* and the medial side surface 206*b*, and a posterior side surface 206*d*, 206*d'*-206''' extending around the heel region 16 between the lateral side surface 206*a* and the medial side surface 206*b*. The anterior side surface 206*c* may be defined by a toe cap, or tab 208, which protrudes from the upper surface 204 and is configured to attach or bond to the upper 100 at the anterior end 18.

A transition 209 may be formed at the intersection of the ground-engaging surface 202 and the side surface 206, and may be defined by a variable radius $R_T$, $R_{T1}$, $R_{T2}$ extending around the periphery of the sole structure 200. For example, in the forefoot region 12 and the heel region 14 the transition 209 may be defined by a first radius $R_{T1}$ providing a relatively pronounced transition 209 between the ground-engaging surface 202 and the side surface 206. Conversely, the transition 209 between the ground-engaging surface 202 and the side surface 206 in the mid-foot region 14 may be defined by a relatively large radius $R_{T2}$, whereby the ground-engaging surface 202 and the side surface 206 are substantially continuously formed.

Figure 8A:
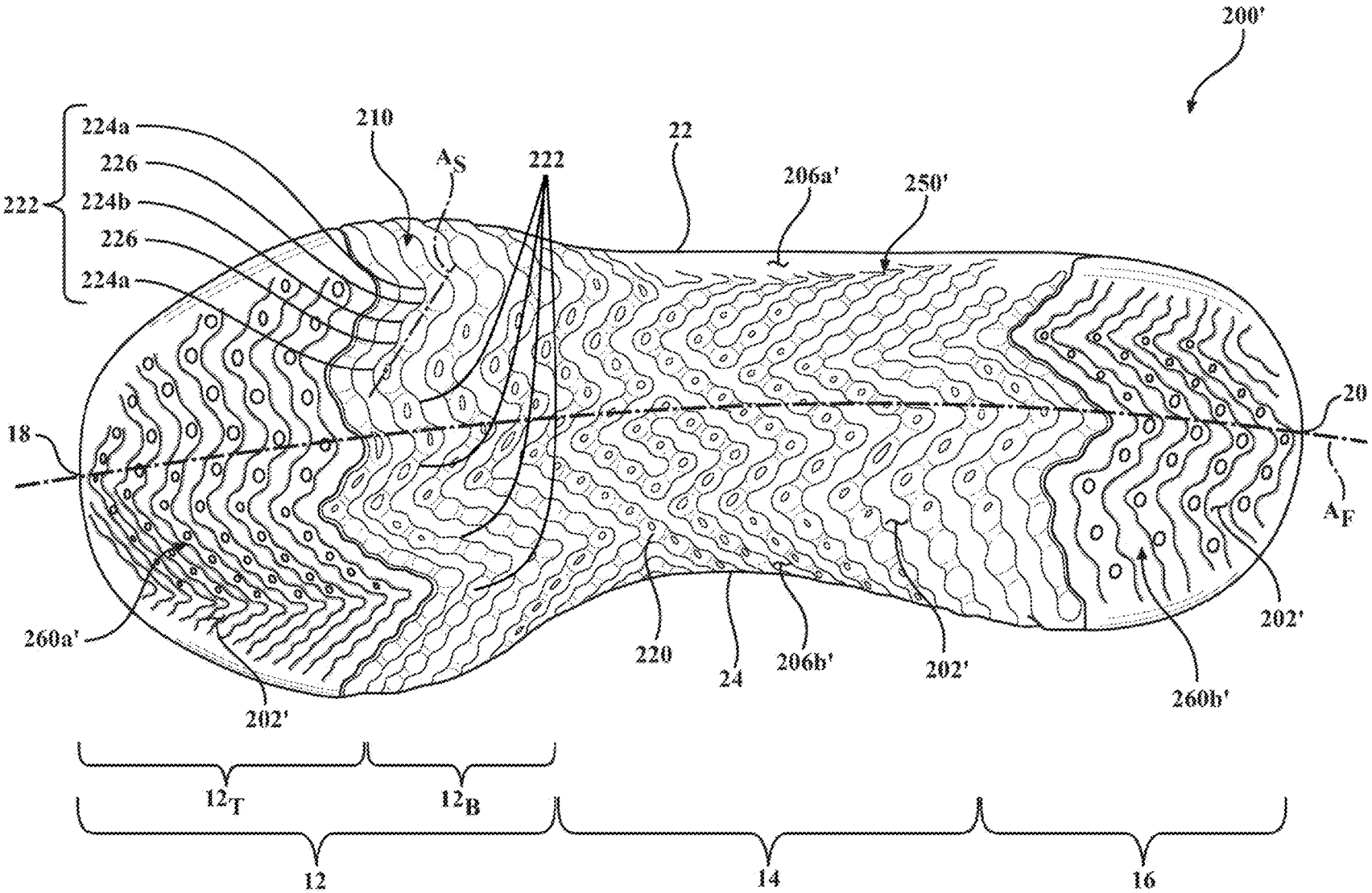
FIGS. 8A-8C are bottom views of the sole structure of FIG. 7.
Figure 8B:
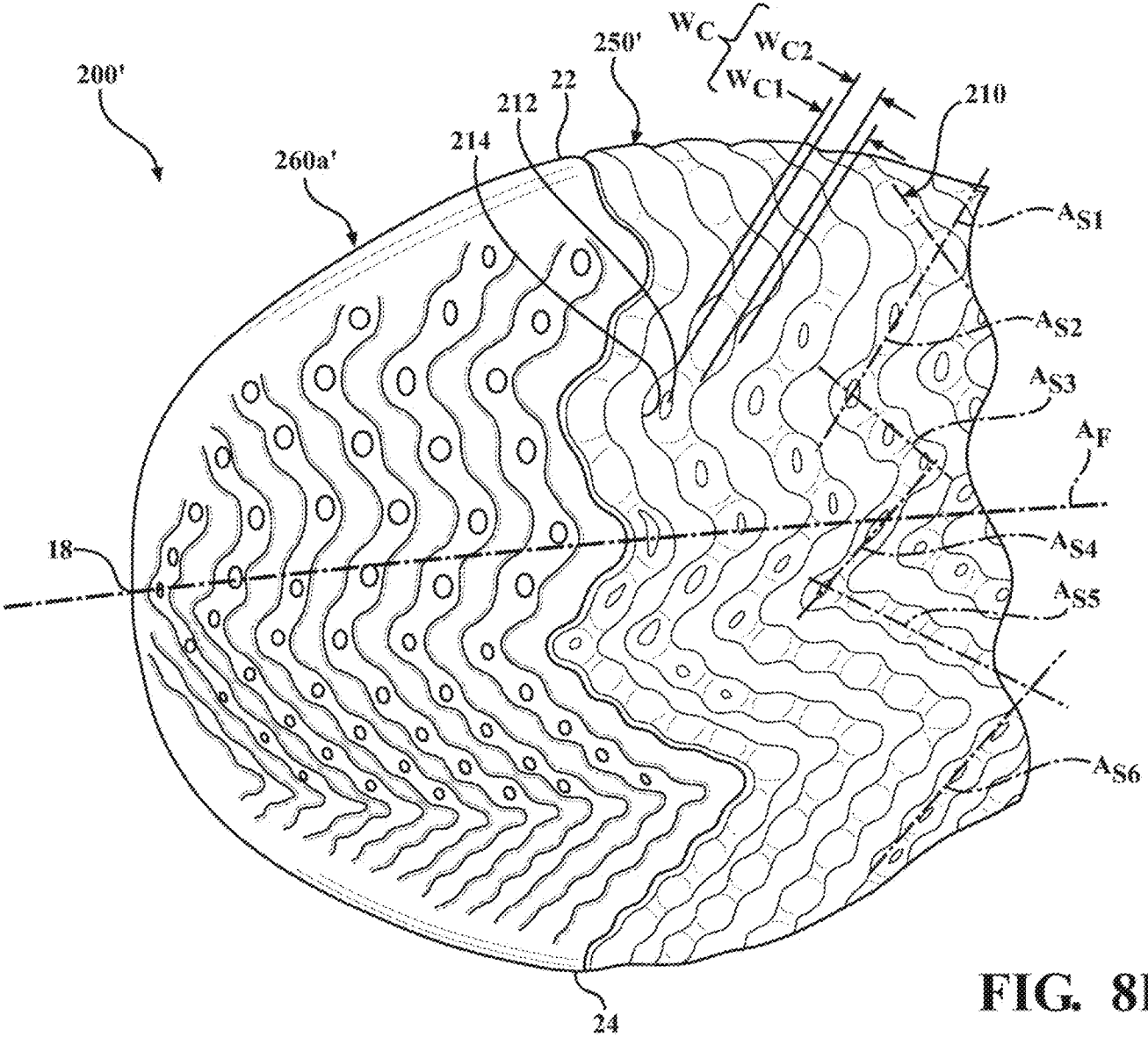
Figure 8C:
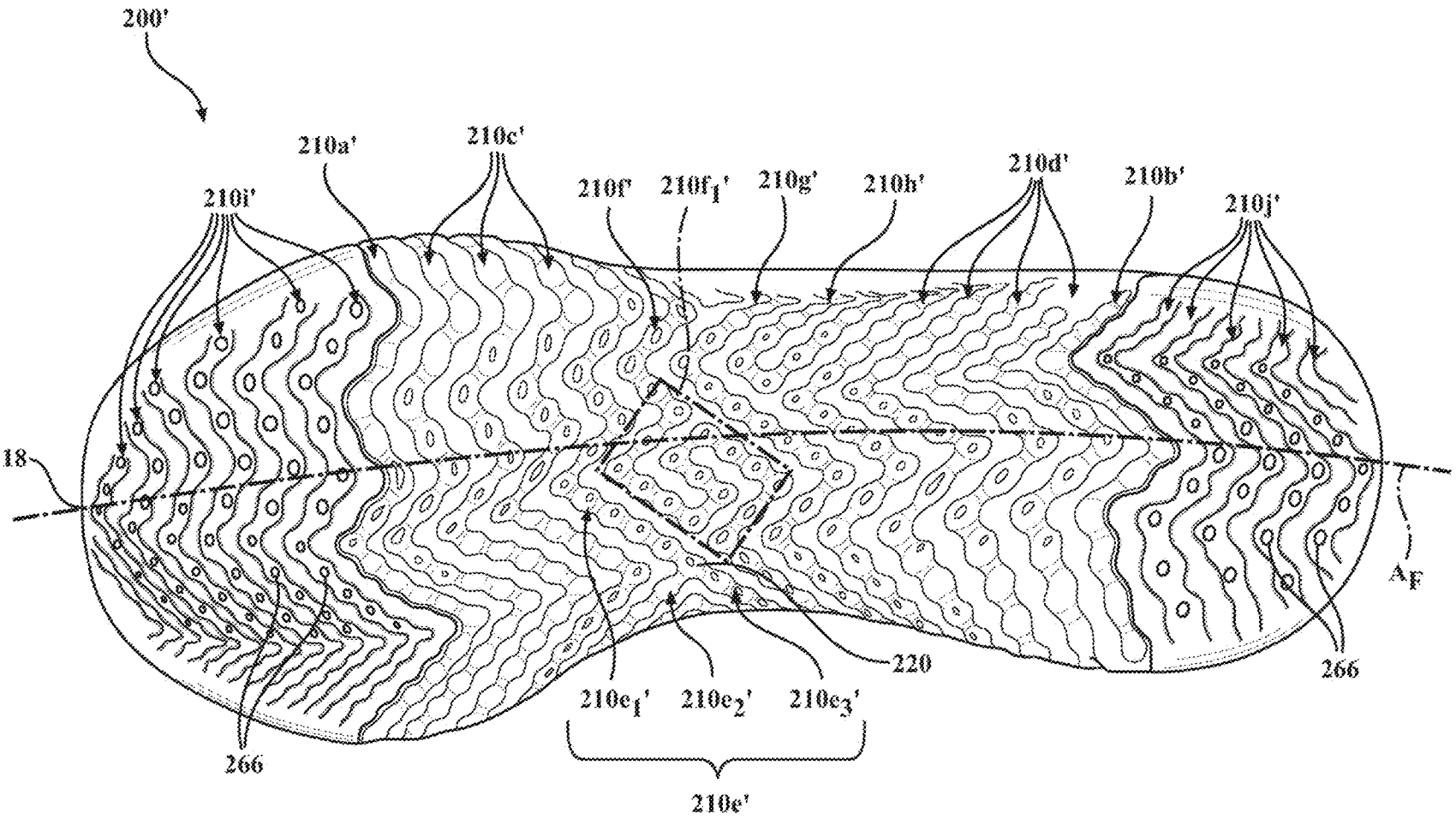
Figure 14B:
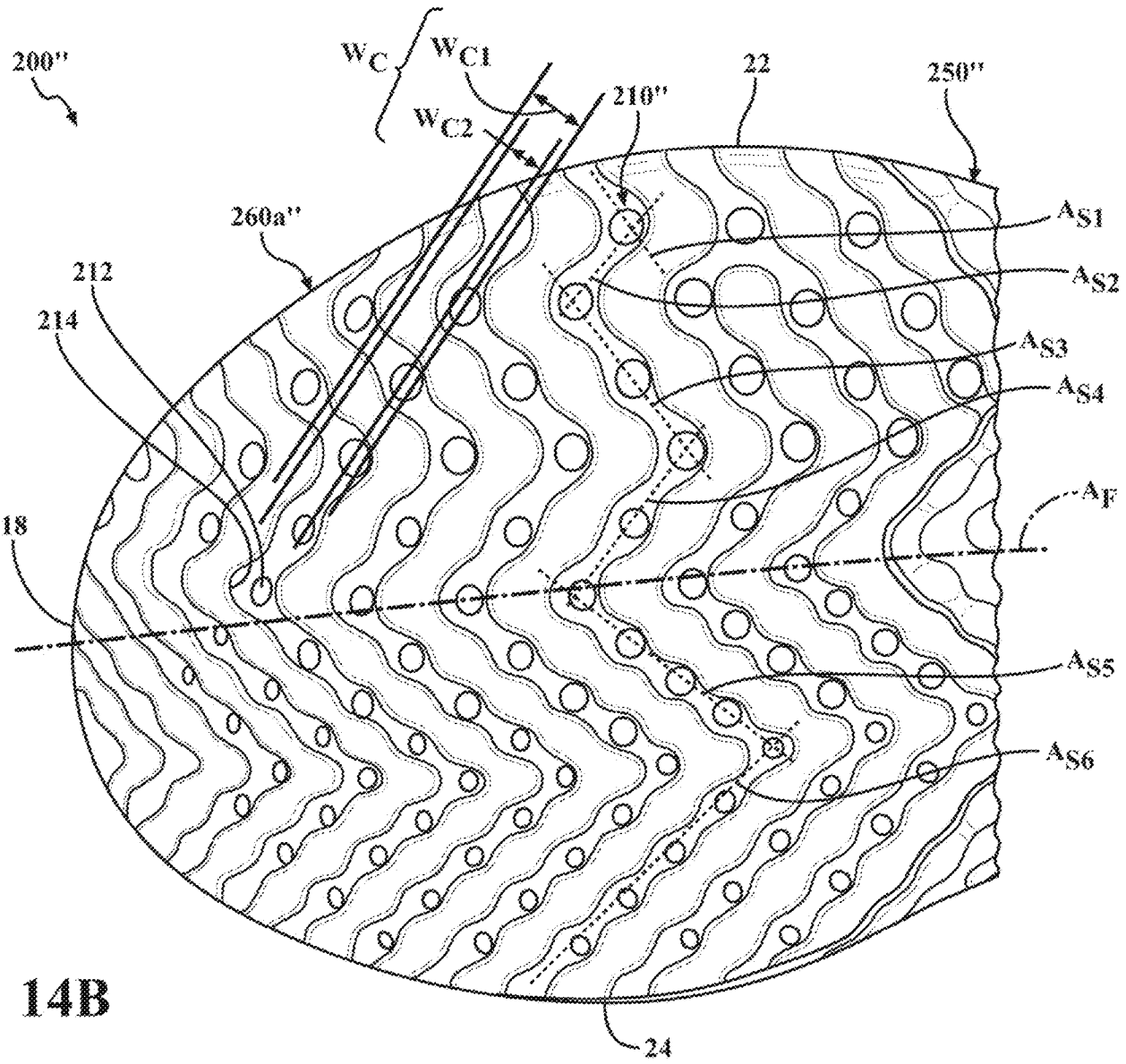
Figure 14C:
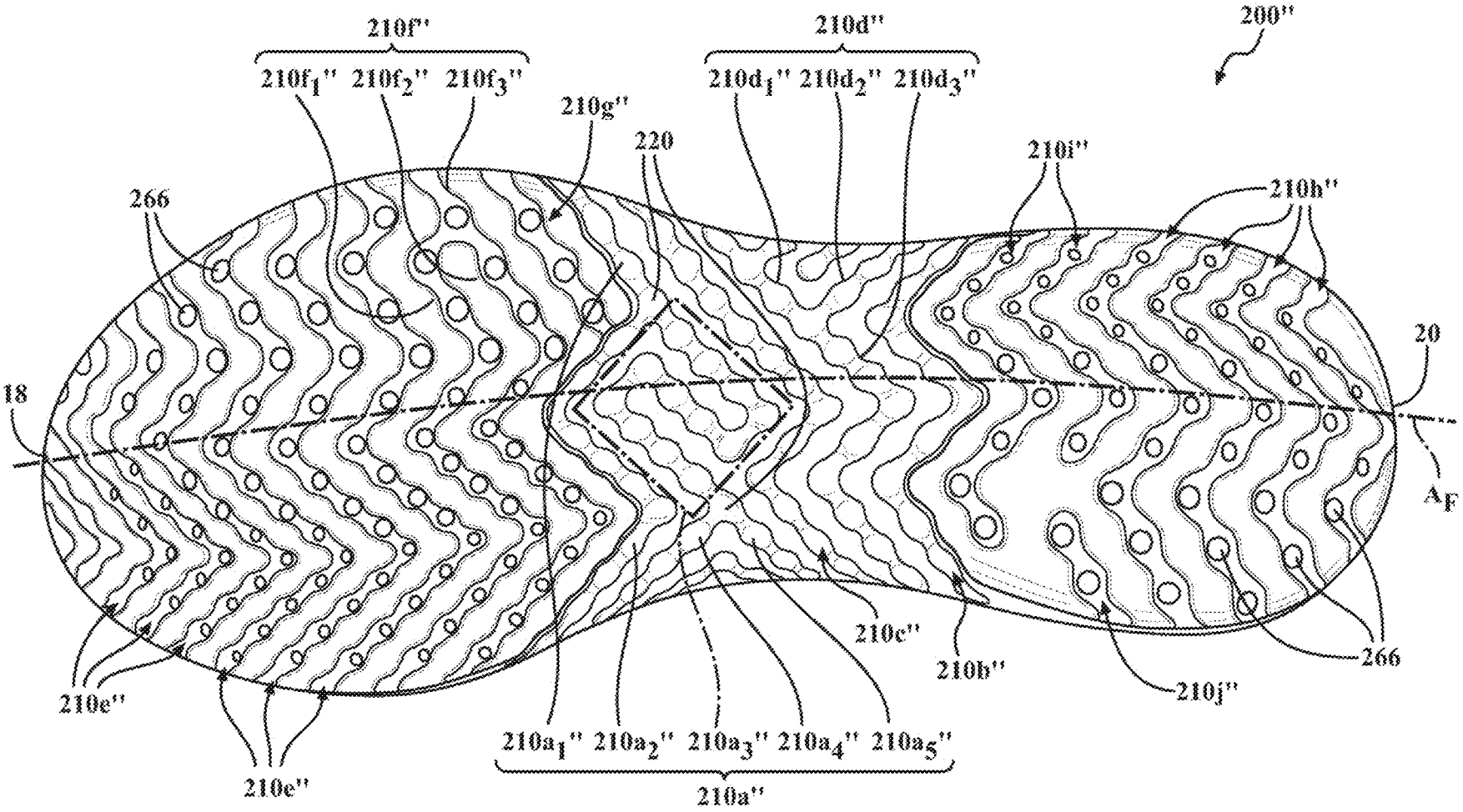
Figure 20B:
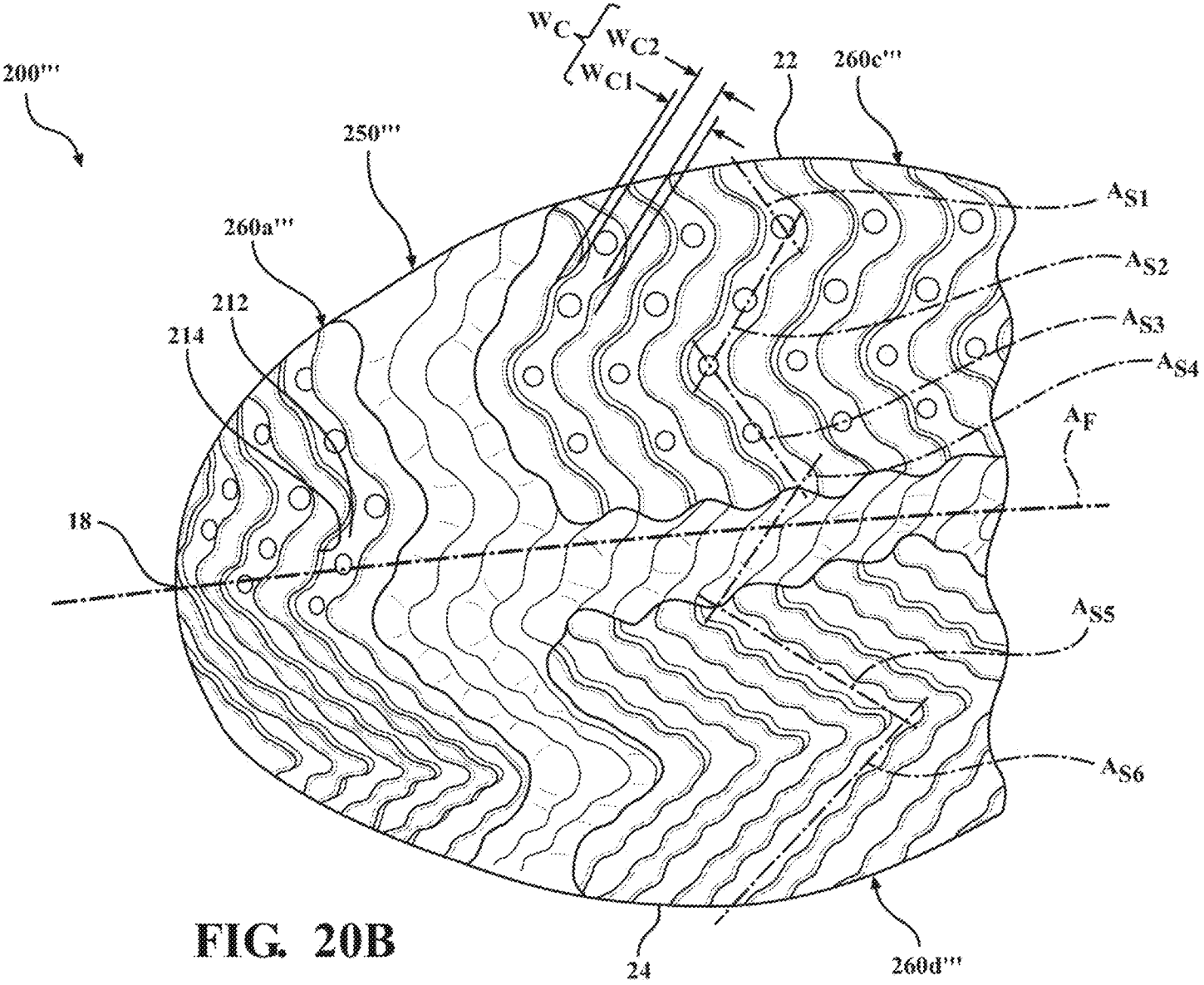
Figure 20C:
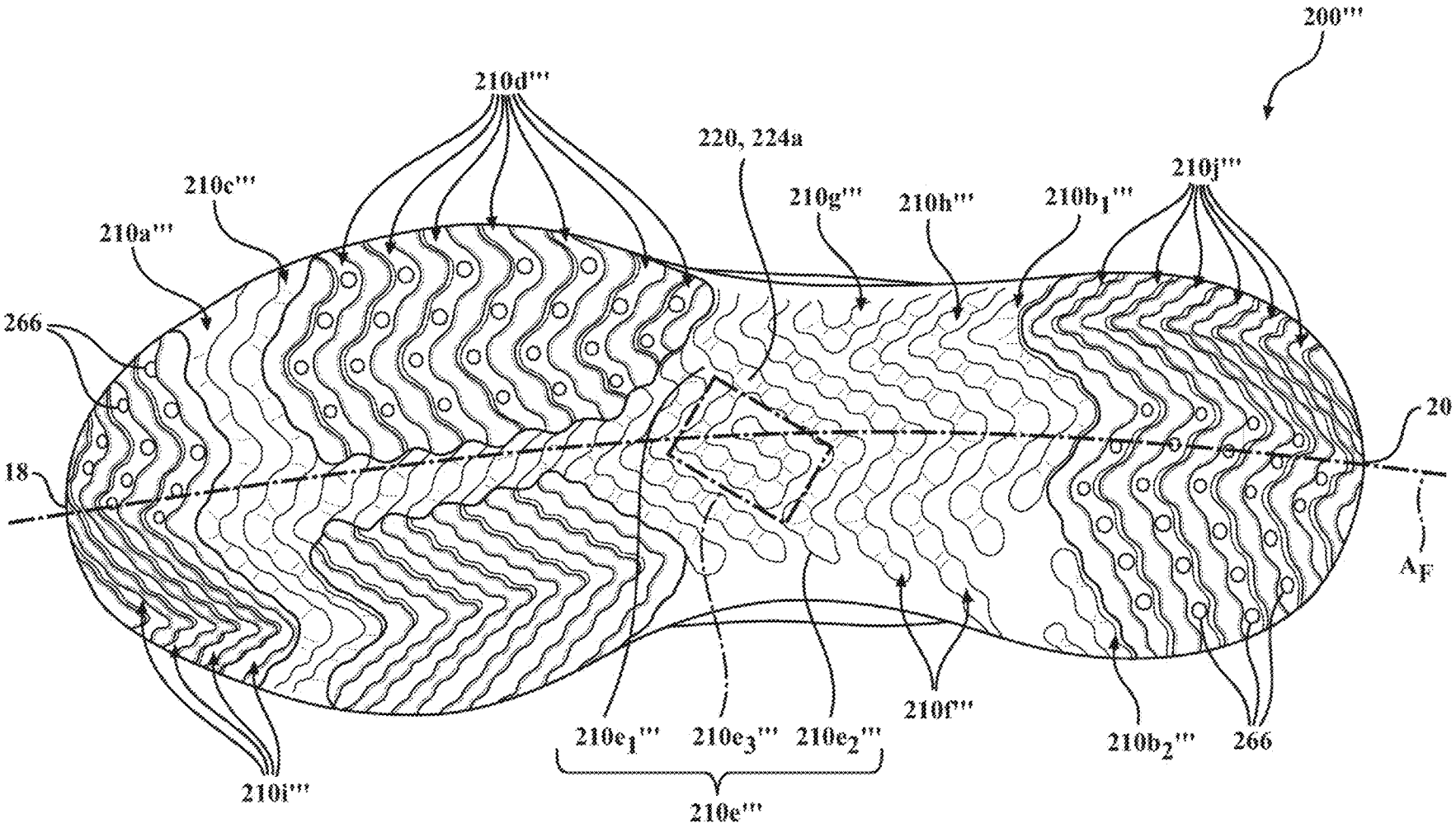
Figure 21:
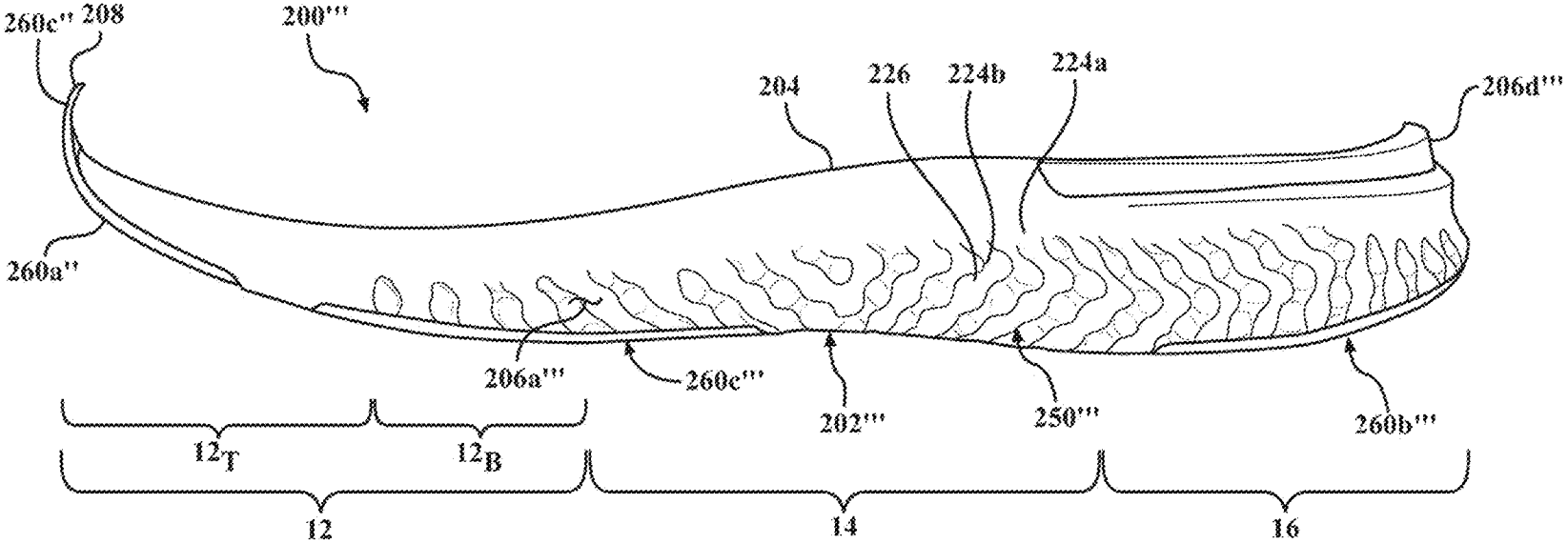
FIG. 21 is a lateral-side elevation view of the sole structure of FIG. 19.
Figure 22:
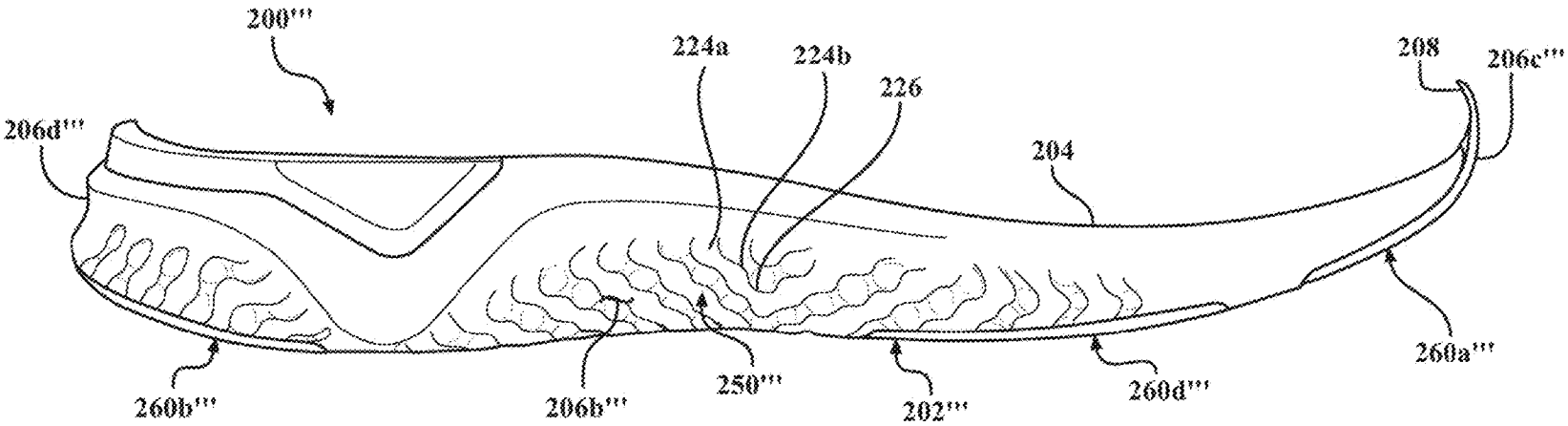
FIG. 22 is a medial-side elevation view of the sole structure of FIG. 19.
Figure 23:
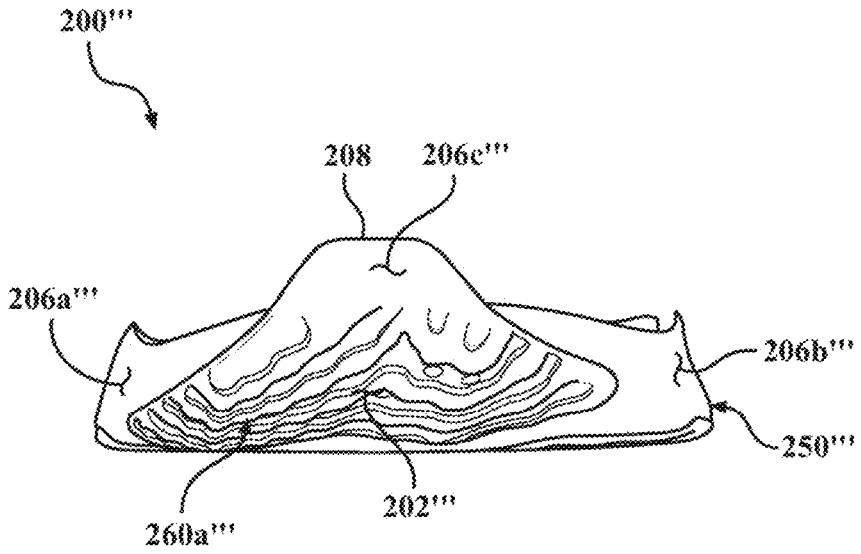
FIG. 23 is a front elevation view of the sole structure of FIG. 19.
Figure 24:
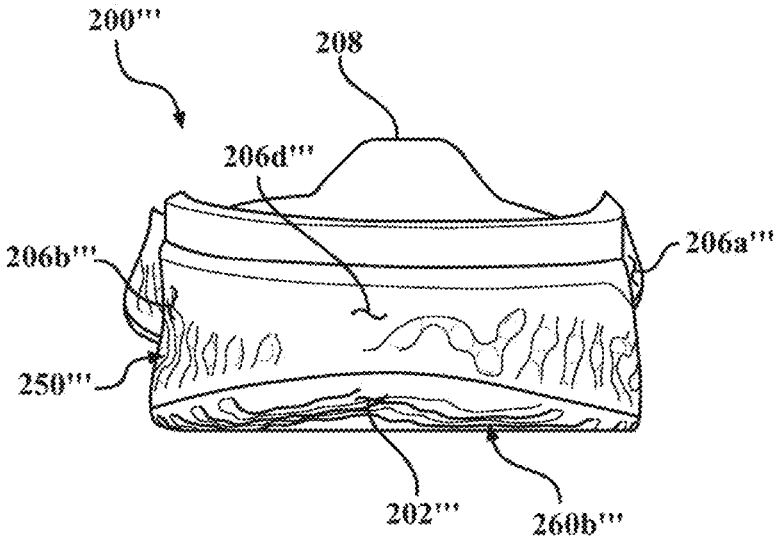
FIG. 24 is a rear elevation view of the sole structure of FIG. 19.

The sole structure 200 further includes a plurality of channels 210, 210'-210''' formed therein. The channels 210 are defined by a recessed surface 212 offset from the ground-engaging surface 202 by a depth $D_C$, and an opposing pair of sidewalls 214 extending from the ground-engaging surface 202 to the recessed surface 212. A distance between the sidewalls 214 defines a width $W_C$ of the channels 210, as shown in FIGS. 8C, 14C, and 20C. As described in greater detail below, the depths $D_C$ and the widths $W_C$ of the channels 210 may be variable along lengths of the channels 210.

Each of the channels 210 includes a plurality of elongate segments 222. Each of the segments 222 includes two or more nodes 224 connected to each other by intermediate necked regions 226, and extends from a first end node 224*a* to a second end node 224*a* along a longitudinal segment axis $A_S$, as shown in FIG. 8A. One or more of the segments 222 may further include intermediate nodes 224*b* disposed between the end nodes 224*a* along the segment axis $A_S$, and interconnected to each other by the necked regions 226. Accordingly, the end nodes 224*a*, the intermediate nodes 224*b*, and the necked regions 226 of a respective segment 222 are all aligned along a common segment axis $A_S$. With reference to FIGS. 8B, 14B, and 20B, the segment axes $A_{S1-n}$ of each of the segments 222 may be arranged at oblique angles with respect to the longitudinal axis AF of the footwear 10.

As discussed above, the width We of each of the channels 210 is variable along a length of the channels 210. More specifically, the width $W_C$ is variable along each segment 222, whereby a first width $W_{C1}$ of the segment 222 at the nodes 224 is greater than a second width $W_{C2}$ of the segment 222 at each of the necked regions 226, as shown in FIGS. 8B, 14B, and 20B. Alternatively, the sidewalls 214 may be described as having an undulated shape, whereby the sidewalls 214 of each segment 222 converge with each other through the necked regions 226 and diverge through the nodes 224.

The segments 222 of each channel 210 may be serially arranged at alternating oblique or right angles to each other. Accordingly the segment axes $A_{S1-n}$ of connected ones of the segments 222 are transverse to each other and define a waveform or chevron shape, as shown in FIGS. 8B, 14B, and 20B. One or more of the channels 210 may define a single, continuous path, whereby the segments 222 are serially arranged in an end-to-end arrangement. For example, a first segment 222 may extend from a first end node 224*a* to a second end node 224*a* along a first segment axis $A_{S1}$, and a second segment 222 may extend from the second end node 224*a* to a third end node 224*a* along a second segment axis $A_{S2}$ at an oblique or right angle with respect to the first segment axis $A_{S1}$. Further, a third segment 222 may extend from the third end node 224*a* to a fourth end node 224*a* along a third segment axis $A_{S3}$ at an oblique or right angle to the second segment axis $A_{S2}$ and substantially parallel (e.g. within approximately 5 degrees) to the first segment axis $A_{S1}$. In addition or alternative to serially-arranged channels 210, the sole structure 200 may include branched channels 210, whereby three or more sub-channels 210 diverge from a common end node 224*a* defining a junction 220. In some examples, one or more channels 210 may include serpentine portions, wherein one or more segments 222 of a channel is disposed between two or more other segments of a channel 210, as described below.

In some implementations, the sole structure 200 may be compositely formed of a main body 250, 250'-250''' and one or more inserts 260, 260'-260''', which cooperate to define the ground-engaging surface 202 of the sole structure 200. As discussed in greater detail below, the main body 250 includes one or more sockets 252, 252'-252''' each configured to receive a corresponding one of the inserts 260, thereby allowing regions of the ground-engaging surface 202 and side surfaces 206 defined by the inserts 260 to be flush with regions of the ground-engaging surface 202 and side surfaces 206 defined by the main body 250. Interfaces between the inserts 260 and the main body 250 may be defined by the channels 210, such that an interface between an insert 260 and the main body 250 has a profile substantially similar to a profile of the one of the channels 210. Additionally or alternatively, the main body 250 and the inserts 260 may cooperate to define the channels 210 of the sole structure 200, whereby one or more of the channels 210 may extend substantially uninterrupted between the main body 250 and the one or more inserts 260.

Figure 7:
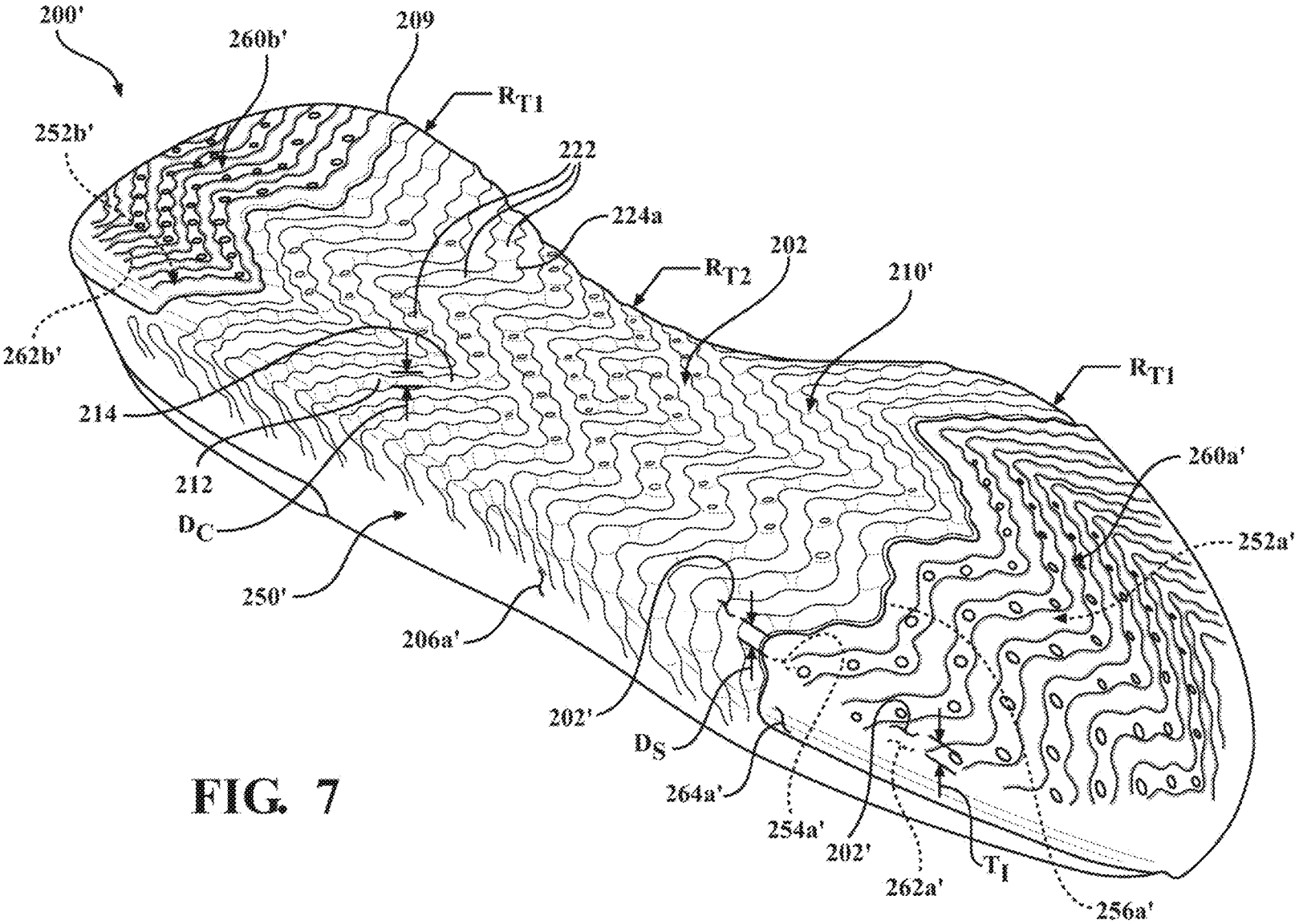
FIG. 7 is a bottom perspective view of a sole structure of the article of footwear of FIG. 1, showing a geometry and configuration of a plurality of segments associated with a ground-contacting surface of a sole structure.
Figure 13:
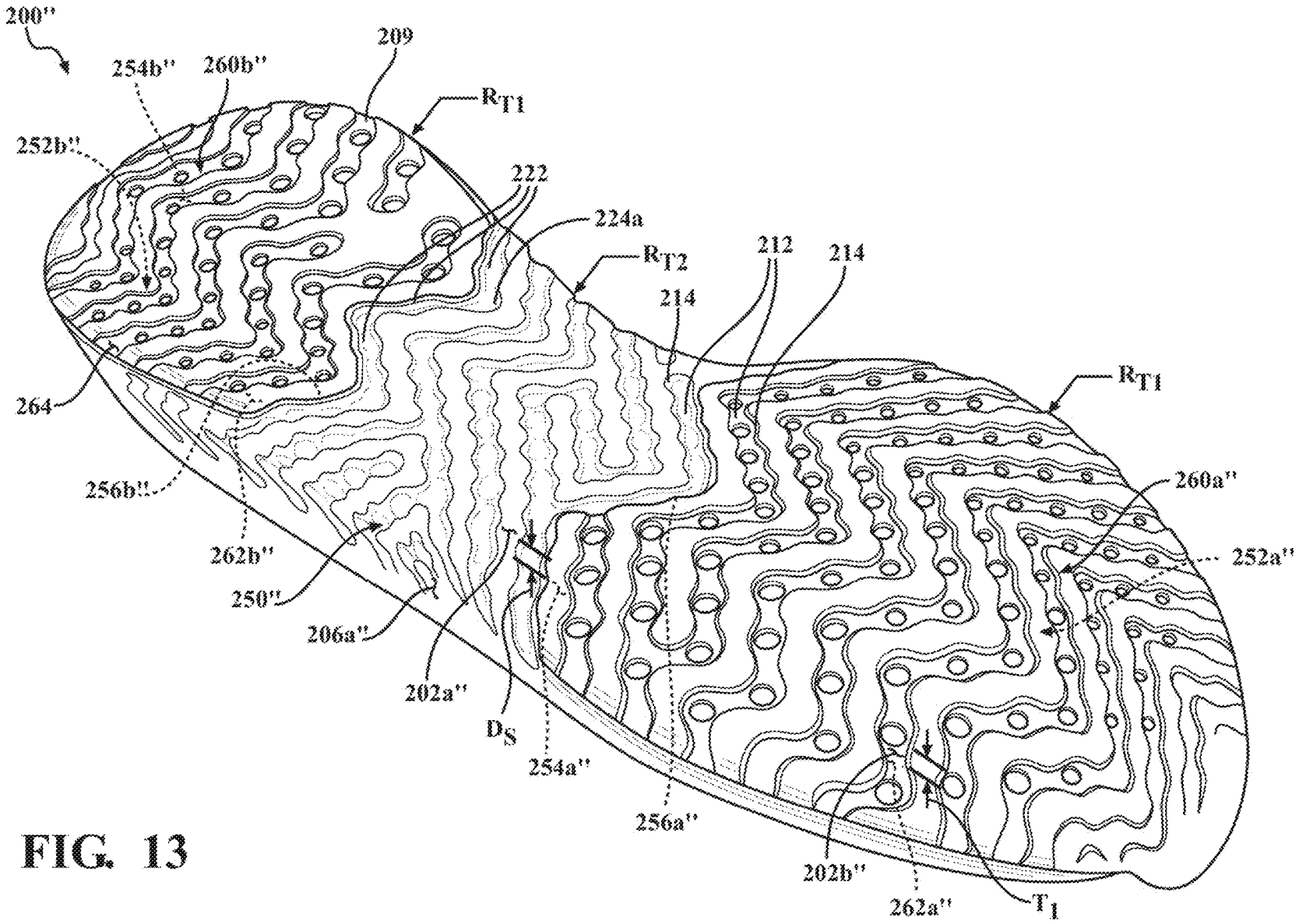
FIG. 13 is a bottom perspective view of a sole structure of the article of footwear of FIG. 1, showing a geometry and configuration of a plurality of segments associated with a ground-contacting surface of a sole structure.
Figure 19:
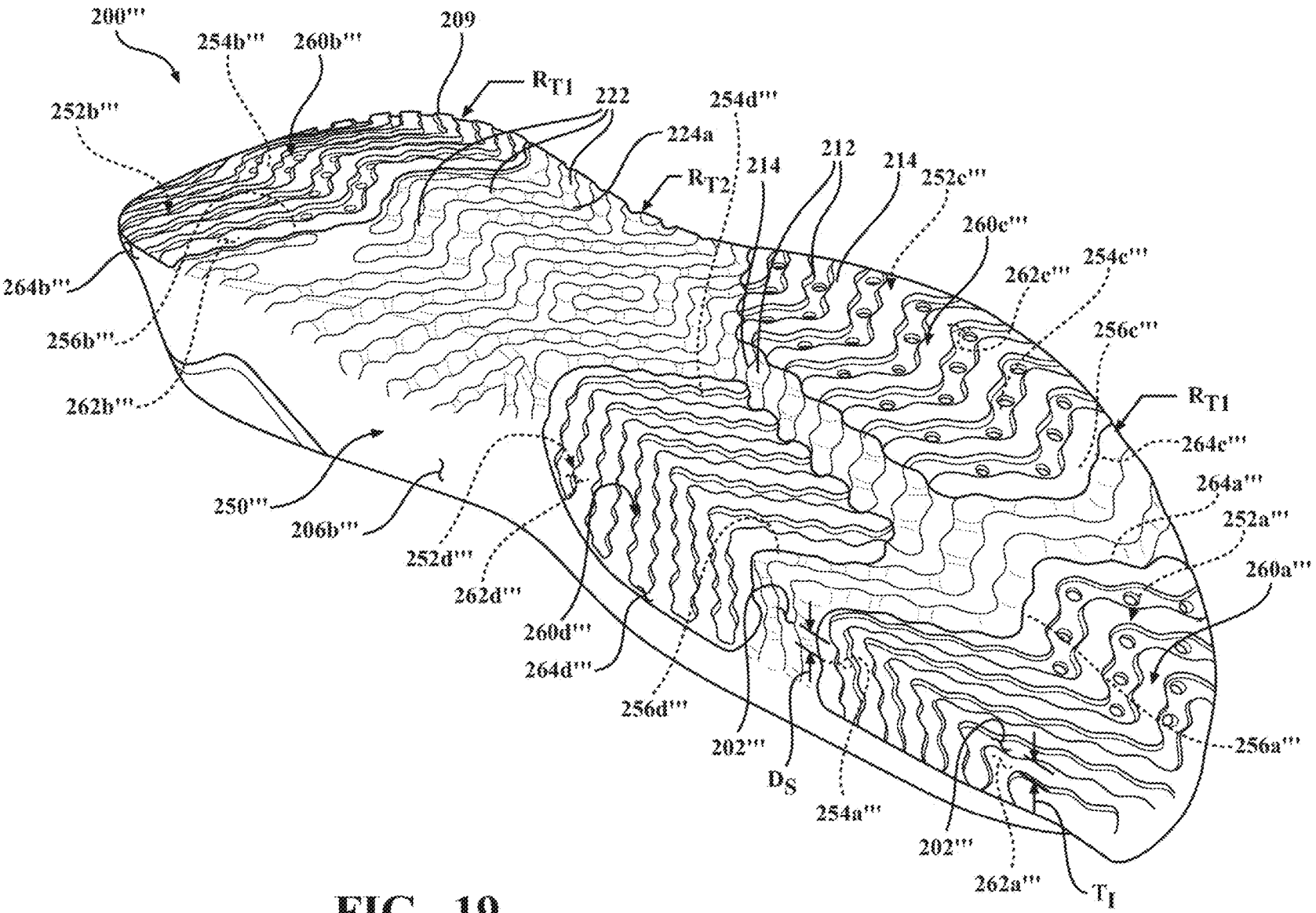
FIG. 19 is a bottom perspective view of a sole structure of the article of footwear of FIG. 1, showing a geometry and configuration of a plurality of segments associated with a ground-contacting surface of a sole structure.

With reference to FIGS. 7, 13, and 19, each of the sockets 252 is defined by a recessed surface 254, 254'-254''' (hidden) offset from the ground-engaging surface 202 of the main body by a depth Ds. At least a portion of an outer periphery of each of the sockets 252 is defined by one or more sidewalls 256, 256'-256' extending between the recessed surface 254 and the ground-engaging surface 202. The sidewall 256 of the socket 252 may intersect one or more of the side surfaces 206 of the sole structure 200, thereby defining an opening (not shown) or notch through the side surface(s) 206.

The inserts 260 are configured to be received within the sockets 252 of the main body 250. Accordingly, the inserts 260 are defined by an inner surface 262, 262'-262' (hidden) opposing the ground-engaging surface 202 and a peripheral surface 264, 264'-264' extending between the inner surface 262 and the ground-engaging surface 202. A distance between the ground-engaging surface 202 and the inner surface 262 defines a thickness $T_1$ of each of the inserts 260, which is substantially similar to the depth Ds of the corresponding socket 252, such that the region of the ground-engaging surface 202 defined by the insert 260 is substantially aligned or coplanar with the regions of the ground-engaging surface 202 defined by the main body 250.

A profile of the peripheral surface 264 of each insert 260 corresponds to a profile defined by the sidewalls 256 and opening of the corresponding socket 252. Accordingly, the peripheral surface 264 of the insert 260 mates with the sidewall 256 of the socket 252 to provide a continuous and uninterrupted transition between the main body 250 and the insert 260 along the ground-engaging surface 202. Further the portions of the peripheral surface 264 extending along the opening of the socket 252 are substantially flush with the corresponding side surfaces 206 defined by the main body 250 to provide a continuous and uninterrupted transition between the main body 250 and the insert 260 along the side surfaces 206.

As shown, the main body 250 defines the upper surface 204 and the side surfaces 206 of the sole structure 200, and further defines one or more regions of the ground-engaging surface 202. Accordingly, the main body 250 is configured to provide the functions of both a traditional midsole as well as an outsole, and may be formed of a molded foam material providing a range of desirable properties, including durability, energy return, cushioning, traction, and support. Examples of suitable materials are disclosed in U.S. Patent Application Publication Numbers US 2017/0267845, US 2017/0267846, US 2017/0267847, US 2017/0267848, US 2017/0267849, and US 2017/0267850, which are hereby incorporated by reference in their entirety.

The inserts 260 are generally located in regions of the ground-engaging surface 202 that are more likely to be subjected to increased point loads relative to the regions of the ground-engaging surface 202 defined by the foam material of the main body 250. Accordingly, the inserts 260 are formed of a material having a greater coefficient of friction, durability, and abrasion resistance than the material of the main body 250.

As discussed above, the channels 210 of the sole structure 200 may extend continuously along the ground-engaging surface 202. Accordingly, one or more of the channels 210 may traverse both the main body 250 and one or more of the inserts 260 in a substantially continuous, and uninterrupted manner. For example, a first one of the segments 222 may be formed in one of the inserts 260, and may connect to a second one of the segments 222 formed in the main body 250. Additionally or alternatively, a single one of the segments 222 may extend from the main body 250 to the insert 260, or vice versa.

As shown in FIGS. 7, 13, and 19, the portions of the channels 210 defined by the main body 250 may be formed with "softer" edges than the portions of the channels 210 defined by the inserts. For example, the edges formed by the intersection of the recessed surface 212 and the sidewalls 214 of the channels 210 may have a greater radius in the main body 250 than in the inserts 260. In some examples, the recessed surface 212 and the sidewalls 214 defining the channels 210 formed in the main body 250 may be substantially continuous and define channels 210 having semi-ellipsoidal cross sections. Conversely, the recessed surface 212 and the sidewalls 214 defining the channels formed in the inserts may intersect to define channels 210 having polygonal (e.g. rectangular) cross sections.

The distinction in channel definition between the main body 250 and the inserts 260 is configured to maximize traction and to minimize abrasion of the ground-engaging surface 202. For example, although the main body 250 is formed of a durable foam material, it may exhibit lower resistance to abrasion than the material forming the inserts 260. By providing "softened" edges, the channels 210 are less likely to be subjected to concentrations of high load and abrasion, thereby improving durability. Conversely, the inserts 260 are formed of a material having a relatively higher abrasion resistance. Accordingly, the channels 210 of the inserts 260 may be formed with "harder" edges to provide improved traction, especially on soft ground surfaces.

With reference to FIG. 7-12, an example of the sole structure 200, 200' is provided, and includes a main body 250, 250' and a plurality of the inserts 260, 260' cooperating to define the ground-engaging surface 202, 202' having a plurality of the channels 210, 210' formed therein. As discussed hereinabove, the main body 250' is formed of a first, foam material while the inserts 260' are formed of one or more rubber materials.

As shown in FIGS. 7 and 8, the main body 250' defines a first region of the ground-engaging surface 202' and the one or more side surfaces 206' extending between the ground-engaging surface 202' and an upper surface 204 of the sole structure 200'.

Figure 9:
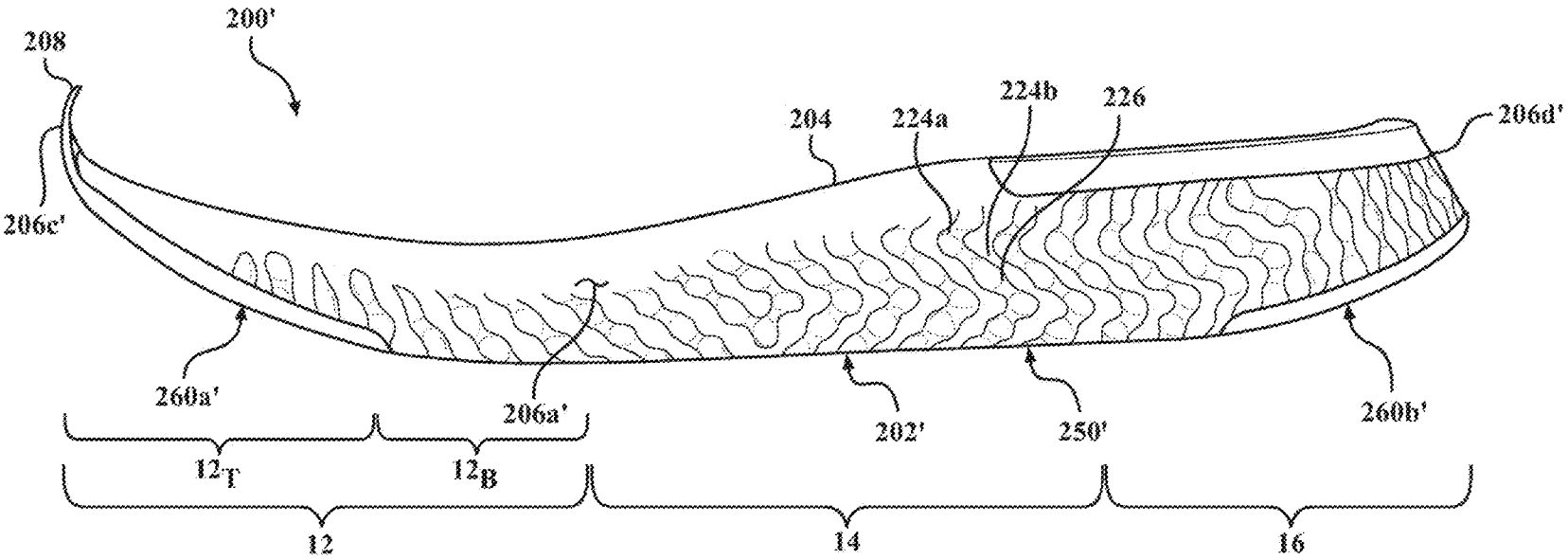
FIG. 9 is a lateral-side elevation view of the sole structure of FIG. 7.
Figure 10:
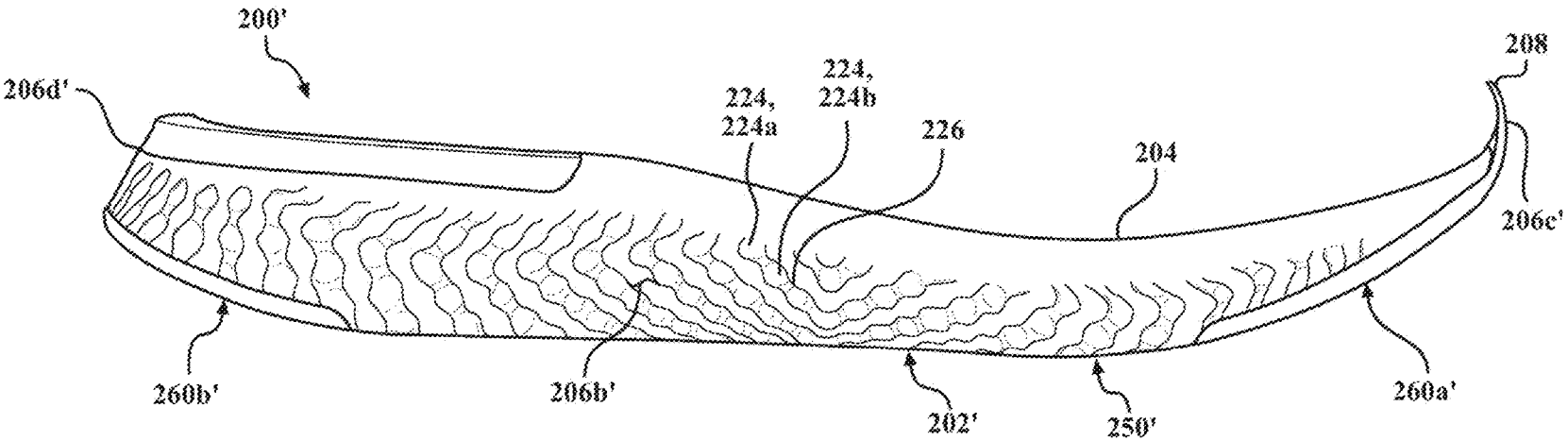
FIG. 10 is a medial-side elevation view of the sole structure of FIG. 7.
Figure 11:
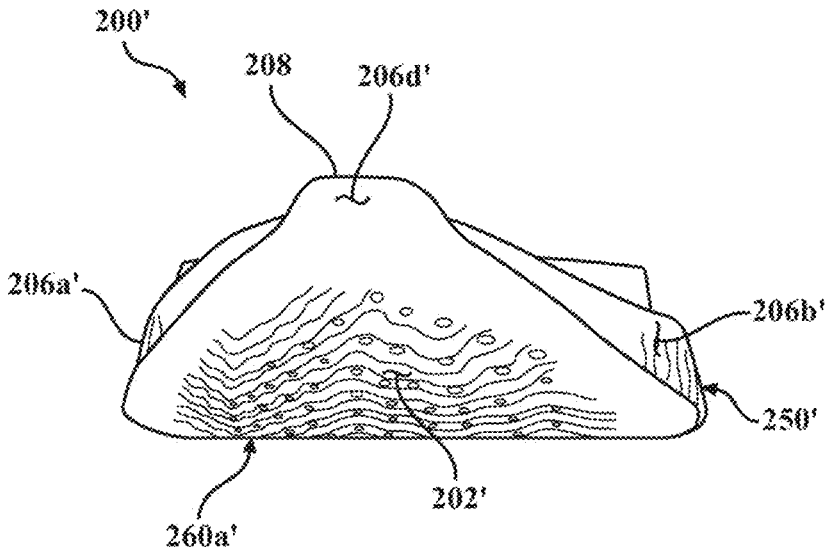
FIG. 11 is a front elevation view of the sole structure of FIG. 7.
Figure 12:
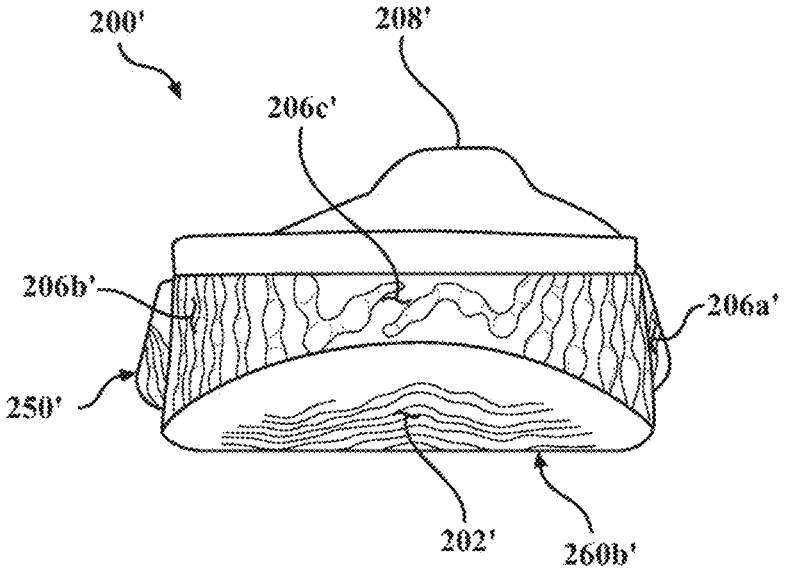
FIG. 12 is a rear elevation view of the sole structure of FIG. 7.

In the illustrated example, the inserts 260' of the sole structure 200' include an anterior insert 260*a*' disposed within an anterior socket 252*a*' of the main body 250', and a posterior insert 260*b*' disposed within a posterior socket 252*b*' of the main body. As shown in FIGS. 7-9, the anterior insert 260*a*' extends from the anterior end 18 to the ball region 12*b*, and from the lateral side 22 to the medial side 24. Accordingly, the anterior insert 260*a*' substantially defines the ground-engaging surface 202' in the toe portion 12T of the forefoot region 12. The posterior insert 260*b*' extends from the posterior end 20 to an intermediate portion of the heel region 16, and extends from the lateral side 22 to the medial side. The intermediate portion of the heel region 16 may be defined by a transition between a convex portion of the ground-engaging surface 202', which extends forward from the posterior end 20, and a substantially flat portion of the ground-engaging surface 202', as illustrated in FIG. 9. Accordingly, the main body 250' defines the ground-engaging surface 202' extending from the toe portion $\mathbf{12}_T$ to the intermediate portion of the heel region 16, and interfaces with the anterior insert 260*a*' and the posterior insert 260*b*' at opposing ends, respectively.

The sole structure 200' includes a plurality of the channels 210, 210', 210*a*'-210*j*' formed therein. As shown in FIG. 8C, a first end channels 210', 210*a*' substantially defines a first end of the first region of the ground-engaging surface 202' and a second end channel 210*b*' substantially defines a second end of the first region of the ground-engaging surface 202', whereby sidewalls 256*a*', 256*b*' defining the respective sockets 252*a*', 252*b*' correspond with a profile of the respective end channels 210*a*', 210*b*'. Each of the first end channel 210*a*' and the second end channel 210*b*' include a plurality of serially-arranged segments 222 and extend along the lateral side surface 206*a*', the ground-engaging surface 202', and the medial side surface 206*b*'.

The main body 250' of the sole structure 200' further includes a plurality of third channels 210*c*' formed adjacent to the first end channel 210*a*'. The third channels 210*c*' include serially-arranged segments 222 extending from the lateral side surface 206*a*' to the medial side surface 206*b*'. The segments 222 are arranged at alternating angles to each other to define a waveform or chevron pattern corresponding substantially to the shape of the first end channel 210*a*' such that the channels 210*a*', 210*c*' define a repeating chevron pattern extending in a direction along the longitudinal axis AF towards the posterior end 20. Similarly, a plurality of fourth channels 210*d*' are formed adjacent the second channel 210*b*' and are spaced in the direction along the longitudinal axis AF towards the anterior end 18.

The main body 250' of the sole structure 200' may further include a branched fifth channel 210*e*' extending from the lateral side surface 206*a*' to the medial side surface 206*b*'. The branched fifth channel 210*e*' includes a first sub-channel $\mathbf{210}e_1$' including of a series of segments 222 serially arranged at alternating angles to each other and extending from the lateral side surface 206*a*' to a junction 220 at an intermediate portion of the ground-engaging surface 202'. The branched channel 210*e*' is further defined by a pair of sub-channels $\mathbf{210}e_2$', $\mathbf{210}e_3$' diverging from the first sub-channel $\mathbf{210}e_1$' at the intermediate portion of the ground-engaging surface 202' and each extending onto the medial side surface 206*b*'.

With continued reference to FIG. 8C, the sole structure 200' includes a serpentine sixth channel 210*f*' disposed adjacent to the branched channel 210*e*' and extending from the lateral side surface 206*a*' to the medial side surface 206*b*', and including sub-channel $\mathbf{210}f_1$' having a plurality of segments 222 arranged in a serpentine configuration disposed in a central region of the ground-engaging surface 202'. The serpentine configuration of the sixth channel 210*f* is defined by a first segment 222 extending from a first end node 224*a* to a second end node 224*a* at a first angle, a second segment 222 extending from the second end node 224*a* to a third end node 224*a* at a second angle substantially perpendicular to the first angle, a third segment 222 extending from the third end node 224*a* to a fourth end node 224*a* at the first angle, a fourth segment 222 extending from the fourth end node 224*a* to a fifth end node 224*a* at the second angle, a fifth segment 222 extending from the fifth end node 224*a* to a sixth end node 224*a* at the first angle, and a sixth segment 222 extending from the sixth end node 224*a* to a seventh end node 224*a* at the second angle, whereby the first, third, and fifth segments 222 are parallel to each other, with the fifth segment 222 being disposed intermediate the first segment 222 and the third segment 222. Likewise, the second, fourth, and sixth segments 222 are parallel to each other, with the fourth segment 222 being disposed between the second segment 222 and the sixth segment 222.

The main body 250' of the sole structure 200' may further include a seventh channel 210*h'* having a horseshoe-like shape, whereby a first end and a second end of the seventh channel 210*h'* are both formed on the same side surface, and an intermediate portion of the channel extends onto the ground-engaging surface 202'.

With continued reference to FIG. 8C, the anterior insert 260*a'* includes a plurality of eighth channels 210*i'* that are substantially complementary in shape to the first end channel 210*a'* of the main body 250'. Likewise, the posterior insert 260*b'* includes a plurality of ninth channels 210*j'* that are substantially complementary to the second end channel 210*b'*. Accordingly, the eighth and ninth channels 210*i'*, 210*j'* cooperate with the respective end channels 210*a'*, 210*b'* to define a waveform-shaped interface between the sidewalls 256*a'* of the main body 250' and the peripheral surfaces 264*a'*, 264*b'* of the inserts 260*a'*, 260*b'*.

The widths $W_c$ of the channels 210*i'*, 210*j'* may taper from one side 22, 24 of the sole-structure 200' to the other side 22, 24. For example, in the anterior insert 260*a'*, the widths $W_{C1}$ of the nodes 224 may progressively decrease in a direction from the lateral side 22 to the medial side 24. Conversely, in the posterior insert 260*b'*, the widths $W_{C1}$ of the nodes 224 may progressively increase in a direction from the lateral side 22 to the medial side 24. The channels 210*i'*, 210*j'* of each of the inserts 260*a'*, 260*b'* may include apertures 266 formed therethrough, which expose the underlying recessed surfaces 254*a'*, 254*b'* of the main body 250'. In the illustrated example, the apertures 266 are formed through the nodes 224 of the channels 210*i'*, 210*j'* and progressively decrease or increase in width (i.e. diameter) from one side 22, 24 to the other side 22, 24, similar to the nodes 224.

As discussed above, the inserts 260' of the sole structure 200' are configured to provide regions of the ground-engaging surface 202' with increased traction and abrasion resistance relative to the main body 250'. However, because the material forming the inserts 260' has a greater density than the material forming the main body 250' it is desirable to provide the inserts 260' only in regions of the ground-engaging surface 202' that are subjected to relatively high concentrations of force in order to provide a balance between the overall weight and desired performance of the sole structure 200'. For example, in the example of the sole structure 200' shown in FIGS. 7-12 the anterior insert 260*a'* and the posterior insert 260*b'* are configured to absorb greater forces associated with forward motion, while the main body 250' is configured to define the ground-engaging surface 202' in regions that are subjected to lesser forces than the inserts 260'.

With reference to FIGS. 13-18, another example of the sole structure 200, 200" is provided, and includes a main body 250, 250" and a plurality of the inserts 260, 260" cooperating to define the ground-engaging surface 202, 202" having a plurality of the channels 210, 210" formed therein. As discussed hereinabove, the main body 250" is formed of a first, foam material, while the inserts 260" are formed of one or more rubber materials.

Figure 15:
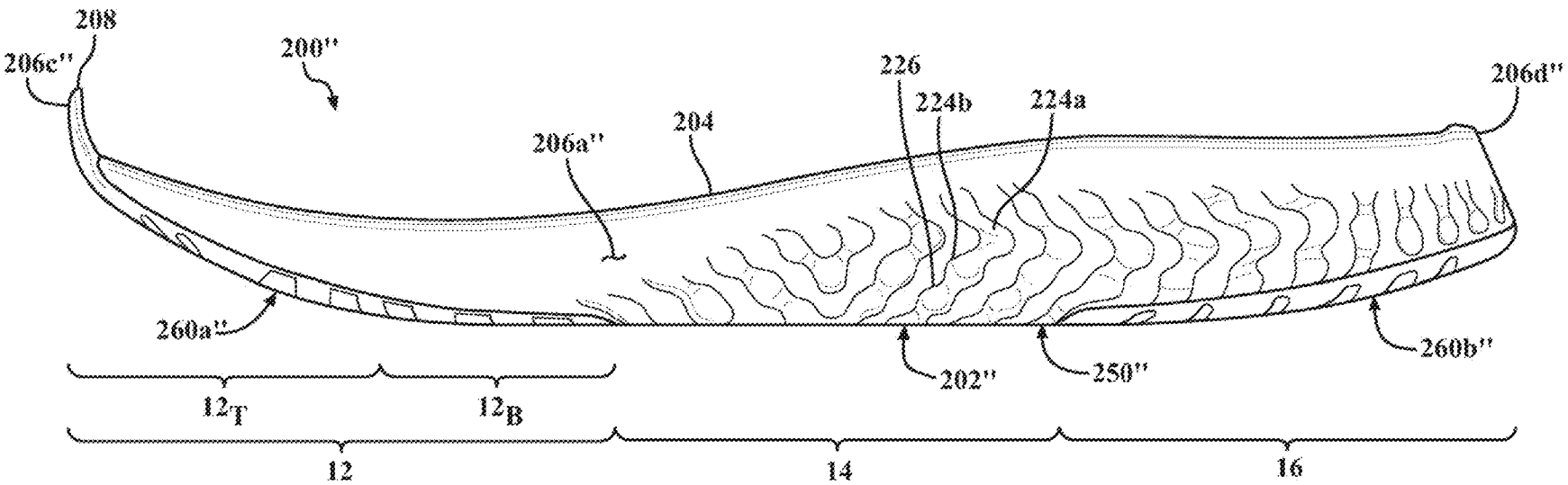
FIG. 15 is a lateral-side elevation view of the sole structure of FIG. 13.
Figure 16:
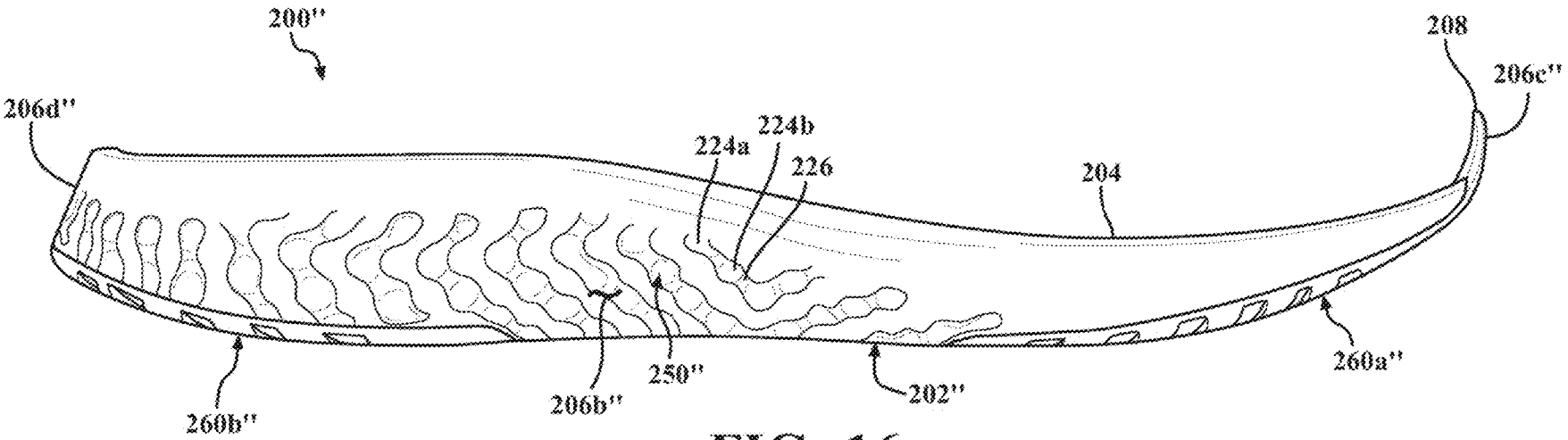
FIG. 16 is a medial-side elevation view of the sole structure of FIG. 13.
Figure 17:
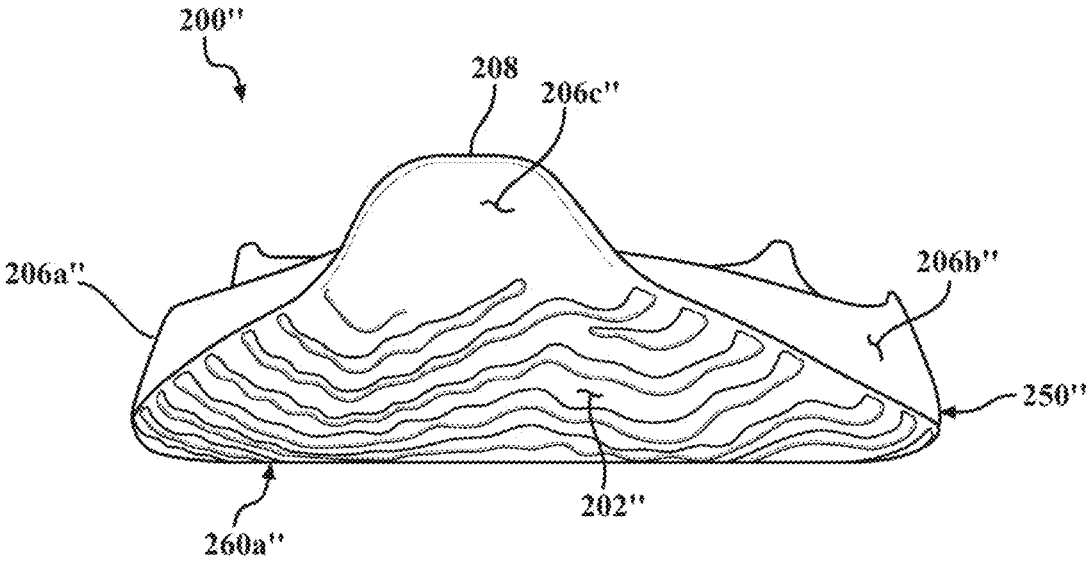
FIG. 17 is a front elevation view of the sole structure of FIG. 13.
Figure 18:
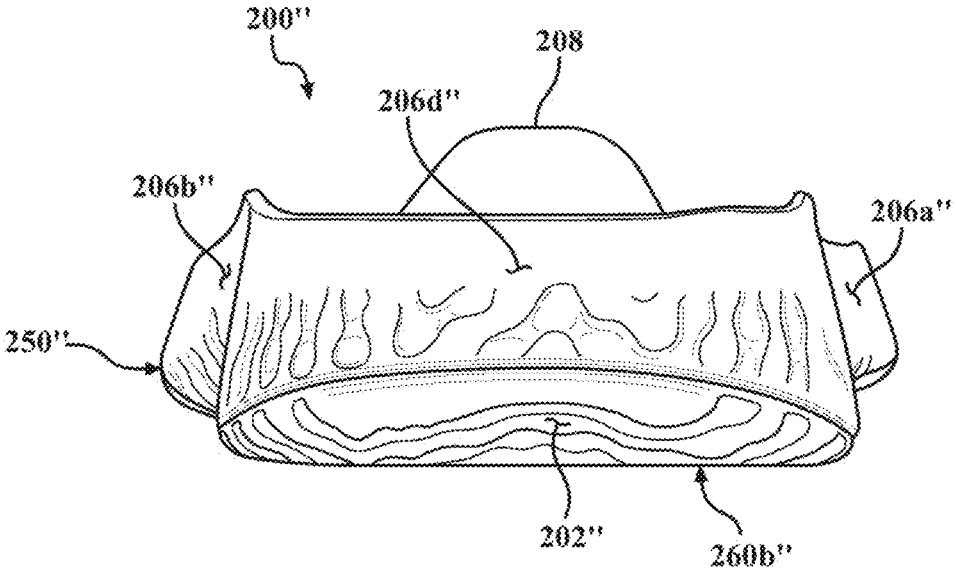
FIG. 18 is a rear elevation view of the sole structure of FIG. 13.

As shown in FIGS. 13 and 14, the main body 250" defines a first region of the ground-engaging surface 202", and the one or more side surfaces 206" extending between the ground-engaging surface 202" and an upper surface 204 of the sole structure 200". In the illustrated example, the sole structure 200" includes an anterior insert 260*a"* disposed within an anterior socket 252*a"* of the main body 250" and a posterior insert 260*b"* disposed within a posterior socket 252*b"* of the main body 250". As shown in FIGS. 14-16, the anterior insert 260*a"* extends from the anterior end 18 to the midfoot region 14, and from the lateral side 22 to the medial side 24. Accordingly, the anterior insert 260*a"* substantially defines the ground-engaging surface 202" in the forefoot region 12 of the sole structure 200". The posterior insert 260*b"* extends from the posterior end 20 to the midfoot region 12, and extends from the lateral side 22 to the medial side 24. Accordingly, the posterior insert 260*b"* substantially defines the ground-engaging surface 202" in the heel region 16 of the sole structure 200". Thus, the main body 250" defines the ground-engaging surface 202" extending through the midfoot region 14, and interfaces with the anterior insert 260*a"* and the posterior insert 260*b"* at opposing ends, respectively.

The sole structure 200' includes a plurality of the channels 210, 210", 210*a"*-210*j"* formed therein. As shown in FIG. 14C, a first end channel 210*a"* substantially defines a first end region of the ground-engaging surface 202" defined by the main body 250", and a second end channel 210*b"* substantially defines a second end of the region of the ground-engaging surface 202" defined by the main body 250", whereby sidewalls 256*a"*, 256*b"* defining the respective sockets 252*a"*, 252*b"* correspond with a profile of the respective end channels 210*a"*, 210*b"*.

With reference to FIG. 14C, the first end channel 210*a"* is branched and comprises a plurality of sub-channels 210$a_{1\text{-}5}$". A first sub-channel 210$a_1$" and a second sub-channel 210$a_2$" are joined at a first junction 220 defined by a first end node 224*a*, and cooperate to define a profile of the sidewall 256*a"* of the anterior socket 252*a"*. A third sub-channel 210$a_3$" extends from the first junction 220 and is arranged in a serpentine configuration disposed in a central portion of the ground-engaging surface 202". The serpentine configuration is defined by a first segment 222 extending from a first end node 224*a* at the first junction 220 to a second end node 224*a* at a first angle with respect to the longitudinal axis AF, a second segment 222 extending from the second end node 224*a* to a third end node 224*a* at a second angle substantially perpendicular to the first angle, a third segment 222 extending from third end node 224*a* to a fourth end node 224*a* at the first angle, a fourth segment 222 extending from the fourth end node 224*a* to a fifth end node 224*a* at the second angle, and a fifth segment 222 extending from the sixth end node 224*a* to a seventh end node 224 at the first angle, whereby the third segment 222 is disposed between and parallel to the first segment 222 and the fifth segment 222. The seventh end node 224 of the third sub-channel 210$a_3$ defines a second junction 220 from which each of the fourth sub-channel 210$a_4$" and the fifth sub-channel 210$a_5$" diverge and extend onto medial side surface 206*b"*.

The second end channel 210*b"* includes a plurality of serially-arranged segments 222 and extends from the lateral side surface 206*a"*, along the ground-engaging surface 202", and onto the medial side surface 206*b"*.

The main body 250" of the sole structure 200" further includes a third channel 210*c"* formed adjacent to the first end channel 210*a"*. The third channel 210*c"* includes serially-arranged segments 222 extending from the lateral side surface 206*a"* to the medial side surface 206*b"*. The segments 222 are arranged at alternating angles to each other to define a waveform or chevron pattern corresponding substantially to the profile of the first end channel 210*a"*.

The main body 250" of the sole structure 200" may further include a branched fourth channel 210", 210*d"* extending from the lateral side surface 206*a"* to the medial side surface 206*b*". The branched fourth channel 210*d*" includes a first sub-channel 210$d_1$" including of a series of segments 222 serially arranged at alternating angles to each other and extending from the medial side surface 206*b*" to an intermediate portion of the ground-engaging surface 202". The branched fourth channel 210*d*" is further defined by a pair of sub-channels 210$d_2$", 210$d_2$" diverging from the first sub-channel 210$d_1$" at the intermediate portion of the ground-engaging surface 202" and each extending onto the lateral side surface 206*a*".

With continued reference to FIG. 8C, the anterior insert 260*a*" includes a plurality of fifth channels 210*e*" extending between the lateral side 22 and the medial side 24 of the anterior insert 260*a*". A branched sixth channel 210*f*" is disposed adjacent to the plurality of the fifth channels 210*e*" and extends continuously between the lateral side 22 and the medial side 24. The branched sixth channel 210*f*" includes a first sub-channel 210$f_1$" extending from the lateral side 22 to a junction 220 in an intermediate portion of the ground-engaging-surface 202", and a pair of sub-channels 210$f_2$", 210$f_3$" diverging from the junction 220 and extending to the medial side 24 of the anterior insert 260*a*". The anterior insert 260*a*" further includes a seventh channel 210*g*" disposed intermediate the branched sixth channel 210*f*" and the first end channel 210*a*" of the main body 250". The seventh channel 210*f*" extends from the lateral side 22 of the anterior insert 260*a*" and intersects the first end channel 210*a*" formed in the main body 250".

The posterior insert 260*b*' includes a plurality of eighth channels 210*h*" extending between the lateral side 22 and the medial side 24 of the posterior insert 260*b*'. A pair of ninth channels 210*i*" extend from the lateral side 22 of the posterior insert 260*b*" to terminal ends intermediate the longitudinal axis AF and the medial side 24. Similarly, a tenth channel 210*j*" extends from the medial side 24 to a terminal end intermediate the longitudinal axis AF and the medial side 24

The widths $W_c$ of the channels 210*a*"-210*j*" may taper from one side 22, 24 of the sole-structure 200" to the other 22, 24. For example, in the anterior insert 260*a*", the widths $W_{C1}$ of the nodes 224 may progressively decrease in a direction from the lateral side 22 to the medial side 24. Conversely, in the posterior insert 260*b*", the widths $W_{C1}$ of the nodes 224 may progressively increase in a direction from the lateral side 22 to the medial side 24. The channels 210*i*"-210*j*" of each of the inserts 260*a*", 260*b*" may include apertures 266 formed therethrough, which expose the underlying recessed surfaces 254*a*", 254*b*" of the main body 250". In the illustrated example, the apertures 266 are formed through the nodes 224 of the channels 210*e*"-210*j*" and progressively decrease or increase in width (i.e. diameter) from one side 22, 24 to the other side 22, 24, similar to the nodes 224.

As discussed above, the inserts 260" of the sole structure 200" are configured to provide areas of the ground-engaging surface 202" with increased traction and abrasion resistance. However, because the material forming the inserts 260" has a greater density than the material forming the main body 250" it is desirable to provide the inserts 260" only in regions of the ground-engaging surface 202" that are subjected to relatively high concentrations of force in order to minimize overall weight of the sole structure 200". For example, in the example of the sole structure 200" shown in FIGS. 13-18 the anterior insert 260*a*" and the posterior insert 260*b*" are configured to absorb greater forces associated with forward and side-to-side motion, while the main body is configured to define regions of the ground-engaging surface 202" that are subjected to lesser forces than the regions defined by the inserts 260".

With reference to FIG. 19-24, another example of the sole structure 200, 200'" is provided, and includes a main body 250, 250'" and a plurality of the inserts 260, 260'" cooperating to define the ground-engaging surface 202, 202'" having a plurality of the channels 210, 210'" formed therein. As discussed hereinabove, the main body 250'" is formed of a first, foam material while the inserts 260'" are formed of one or more rubber materials.

As shown in FIGS. 19 and 20, the main body 250'" defines a first region of the ground-engaging surface 202'", and the one or more side surfaces 206'" extending between the ground-engaging surface 202'" and an upper surface 204 of the sole structure 200'". In the illustrated example, the sole structure 200'" includes an anterior insert 260*a*'" received within an anterior socket 252*a*'" of the main body 250'", a posterior insert 260*b*'" received within a posterior socket 252*b*'" of the main body 250'", a lateral insert 252*c*'" disposed within a lateral socket 252*c*'" of the main body 250'", and a medial insert 260*d*'" disposed within a medial socket 252*d*'".

As shown in FIGS. 14-16, the anterior insert 260*a*" extends from the anterior end 18 to an intermediate portion of the forefoot region 12, and from the lateral side 22 to the medial side 24. Accordingly, the anterior insert 260*a*'" substantially defines the ground-engaging surface 202'" in the forefoot region 12 of the sole structure 200'". The posterior insert 260*b*'" extends from the posterior end 20 to an intermediate portion of the heel region 16, and extends from the lateral side 22 to the medial side 24. Accordingly, the posterior insert 260*b*'" substantially defines the ground-engaging surface 202'" in the heel region of the sole structure 200". The lateral insert 206*c*'" extends from a first side adjacent the lateral side 22 of the sole structure to a second side intermediate the lateral side 22 and the longitudinal axis AF, and from a first end opposing the anterior insert 260*a*'" to a second end at the midfoot region 12. Likewise, the medial insert 206*d*'" extends from a first side adjacent the medial side 24 to a second side intermediate the medial side 24 and the longitudinal axis $A_F$, and from a first end opposing the anterior insert 260*a*' to a second end at the midfoot region 12. The inserts 260'" are all spaced apart from each other by the main body 250'".

The sole structure 200' includes a plurality of the channels 210, 210'", 210*a*'"-210*j*'" formed therein. As shown in FIG. 20C, a first end channel 210'", 210*a*'" substantially defines a first end of the first region of the ground-engaging surface 202'", thereby defining a profile of the interface between the peripheral surface 264*a*'" of the anterior insert 260*a*'" and the sidewall 256*a*'" of the anterior socket 252*a*'". The first end channel 210*a*" extends continuously from the lateral side surface 206*a*'" to the medial side surface 206*b*'" along the main body 250'".

A second end channel 210*b*'" substantially defines a second end of the first region of the ground-engaging surface 202'" defined by the main body 250'" and includes a first sub-channel 210$b_1$' and a second sub-channel 210$b_2$'. The first sub-channel 210$b_1$'" extends from the lateral side surface 206*a*'" to a terminal end on the ground-engaging surface 202'", intermediate the longitudinal axis AF and the medial side 24. The second sub-channel 210$b_2$'" extends from the medial side surface 202*b*'" to a terminal end on the ground-engaging surface 202'", intermediate the longitudinal axis AF and the medial side 24. Accordingly, the second channel

210*b*''' may be described as including an interruption between the first sub-channel 210*b*$_1$' and the second sub-channel 210*b*$_2$'''.

A third channel 210*c*''' is disposed adjacent to the first end channel 210*a*''' and extends continuously from the lateral side surface 206*a*''' to the medial side surface 206*b*''' along the ground-engaging surface 202''' and within the main body 250'''. Accordingly, the third channel 210*c*''' substantially defines a profile of the interfaces between the peripheral surfaces 264*c*''', 264*d*''' of the lateral and medial inserts 260*c*''', 260*d*''' and the sidewalls 256*c*''', 256*d*''' of the lateral and medial sockets 252*c*''', 252*d*'''. Particularly, the third channel 210*c*''' defines the interfaces at the first ends of the lateral and medial inserts 260*c*''', 260*d*'''. As shown, the interfaces have a substantially chevron-shaped profile corresponding a profile of the third channel 210*c*'''.

The sole structure 200''' includes a plurality of fourth channels 210*d*''' each extending continuously from the lateral side 22 to the medial side 24 and traversing the main body 250''' and at least one of the lateral insert 260*c*''' and the medial insert 260*d*'''. As shown in FIG. 20C, at least one of the fourth channels 210*d*''' extends from the lateral side 22 along ground-engaging surface of the lateral insert 260*c*''', traverses a portion of the main body 250''' that separates the lateral insert 260*c*''' and the medial insert 260*d*''', and continues across the medial inert 260*d*''' to the medial side 24. Additional channels 210*d*''' may extend from the lateral side 22 along the lateral insert 260*c*''' and continue to the medial side 24 along the main body 250''', adjacent to the second end of the medial insert 260*d*'''.

The main body 250''' includes a branched fifth channel 210*e*''' including a serpentine sub-channel 210*e*$_3$'''. A first sub-channel 210*e*$_1$''' and a second sub-channel 210*a*$_2$''' are joined at a first junction 220 defined by a first end node 224*a* and cooperate to extend continuously from the lateral side surface 206*a*''' to the medial side surface 206*b*'''. A third sub-channel 210*e*$_3$''' extends from the first junction 220 and is arranged in a serpentine configuration disposed in a central portion of the ground-engaging surface 202'''. The serpentine configuration is defined by a first segment 222 extending from the first end node 224*a* at the first junction 220 to a second end node 224*a* at a first angle with respect to the longitudinal axis AF, a second segment 222 extending from the second end node 224*a* to a third end node 224*a* at a second angle substantially perpendicular to the first angle, a third segment 222 extending from the third end node 224*a* to a fourth end node 224*a* at the first angle, and a fourth segment extending from the fourth end node 224*a*, towards the first segment 222 at the second angle, and terminating at a fifth end node 224*a* intermediate the second segment 222 and the second sub-channel 210*a*$_2$''.

The main body 250''' further includes a pair of sixth channels 210*f*''' disposed intermediate the second channel 210*b*''' and the branched fifth channel 210*e*''', and extending from the lateral side surface 206*a*''' to the medial side surface 206*b*'''. A seventh channel 210*g*''' is disposed between the sixth channels 210*f*'' at the lateral side 22 of the sole structure 200''' and extends from a first end on the lateral side surface 206*a*''', onto the ground-engaging surface 202''', and back to a second end on the lateral side surface 206*a*''. An eighth channel 210*b*''' is disposed between the second end channel 210*b*''' and the pair of the sixth channels 210*f*'', and extends from the lateral side surface 206*a*''' to a terminal end on the ground-engaging surface 202', intermediate the longitudinal axis AF and the medial side 24 of the sole structure 200'''.

The anterior insert 260*a*''' includes a plurality of ninth channels 210*i*''' formed therein and extending continuously from the lateral side 22 to the medial side 24. Profiles of the ninth channels 210*i*''' of the anterior insert 260*a*''' are complementary to a profile of the first end channel 210*a*''' and form a repeating chevron pattern along the anterior insert 260*a*'''. Likewise, the posterior insert 260*b*' includes a plurality of tenth channels 210*j*''' formed therein and extending continuously from the lateral side 22 to the medial side 24. Profiles of the tenth channels 210*j*''' are complementary to a profile of the second end channel 210*b*''' and form a repeating chevron pattern along the posterior insert 260*b*''''

The widths $W_c$ of the channels 210*a*'''-210*j*''' may taper from one side 22, 24 of the sole-structure 200''' to the other 22, 24. For example, in the anterior insert 260*a*''', the widths $W_{C1}$ of the nodes 224 may progressively decrease in a direction from the lateral side 22 to the medial side 24. Conversely, in the posterior insert 260*b*''', the widths $W_{C1}$ of the nodes 224 may progressively increase in a direction from the lateral side 22 to the medial side 24.

The channels 210*i*''-210*n*'' of each of the inserts 260*a*''', 260*b*''', and 260*d*''' may include apertures 266 formed therethrough, which expose the underlying recessed surfaces 254*a*''', 254*b*''', and 254*d*''' of the main body 250'''. In the illustrated example, the anterior insert 260*a*''' includes apertures formed through the nodes 224 disposed substantially on the lateral side 24 of the sole structure, while the posterior insert 260*b*''' includes apertures formed through the nodes 224 disposed substantially on the medial side 24 of the sole structure 200'''. As shown, all nodes 224 of the lateral insert 260*c*''' include apertures formed therethrough, while none of the nodes 224 of the medial insert 260*d*''' include apertures. Additionally or alternatively, all of the inserts 260''' may include apertures 266 formed through all of their nodes 224, or none of the inserts 260''' may include apertures 266.

As discussed above, the inserts 260''' of the sole structure 200''' are configured to provide areas of the ground-engaging surface 202''' with increased traction and abrasion resistance. However, because the material forming the inserts 260''' has a greater density than the material forming the main body 250''' it is desirable to provide the inserts 260''' only in regions of the ground-engaging surface 202''' that are subjected to relatively high concentrations of force. For example, in the example of the sole structure 200''' shown in FIGS. 19-24 the anterior insert 260*a*''' and the posterior insert 260*b*''' are configured to absorb relatively high forces associated with forward running, the lateral insert 260*c*''' and the medial insert 260*d*''' are configured to absorb relatively-high forces associated with side-to-side movements, and the main body 250''' is configured to define regions of the ground-engaging surface 202''' that are subjected to lesser forces than the regions defined by the inserts 260'''.

Clause 1: A sole structure for an article of footwear, the sole structure comprising a main body formed of a first material and defining a first portion of a ground-engaging surface including a first channel defined by a first segment extending along a first axis and a second segment extending along a second axis transverse to the first axis, and at least one insert formed of a second material and received by the main body, the at least one insert defining a second portion of the ground-engaging surface and having second channel including a third segment extending along a third axis parallel to the first axis and a fourth segment extending along a fourth axis transverse to the third axis and substantially parallel to the second axis, one of the first channel and the second channel defining an interface between the main body and the insert.

Clause 2: The sole structure of Clause 1, wherein the at least one insert includes an anterior insert defining at least a portion of a forefoot region of the ground-engaging surface, and a posterior insert defining at least a portion of a heel region of the ground-engaging surface.

Clause 3: The sole structure of Clause 2, wherein the anterior insert includes the second channel and the posterior insert includes a third channel having a fifth segment extending along a fifth axis substantially parallel to the first axis and a sixth segment extending along a sixth axis transverse to the fifth axis and substantially parallel to the second axis, the third channel defining an interface between the main body and the posterior insert.

Clause 4: The sole structure of Clause 2, wherein the main body defines at least a portion of a midfoot region of the sole structure and separates the anterior insert from the posterior insert.

Clause 5: The sole structure of Clause 1, wherein the main body is formed of a foam material and the at least one insert is formed of a rubber material.

Clause 6: The sole structure of Clause 1, wherein the main body further defines at least one side surface of the sole structure, a portion of the first channel of the main body extending onto the side surface.

Clause 7: The sole structure of Clause 6, wherein the at least one side surface of the sole structure includes a lateral side surface having a first portion of the first channel formed therein and a medial side surface having a second portion of the second channel formed therein.

Clause 8: The sole structure of Clause 1, wherein the main body includes a socket defined by a recessed surface offset from the ground-engaging surface and a sidewall extending between the ground-engaging surface and the recessed surface and intersecting the at least one side surface to define a notch.

Clause 9: The sole structure of Clause 8, wherein the insert is received by the socket, a first portion of a peripheral surface of the insert mating with the sidewall of the socket and a second portion of the peripheral surface of the insert being disposed in the notch and flush with the at least one side surface.

Clause 10: The sole structure of Clause 1, wherein the first region of the ground-engaging surface is continuous and flush with the second region of the ground-engaging surface.

Clause 11: A sole structure for an article of footwear, the sole structure comprising a main body defining a first region of a ground-engaging surface and at least one side surface extending from the ground-engaging surface, at least one insert received by the main body and defining a second region of the ground-engaging surface, and a first channel defined by a first plurality of segments including a first segment extending from a first node to a second node along a first axis, a second segment extending from a third node to a fourth node along a second axis transverse to the first axis, and a third segment extending from a fifth node to a sixth node along a third axis transverse to the second axis and substantially parallel to the first axis.

Clause 12: The sole structure of Clause 11, wherein the first segment is formed along a first side surface, the second segment is formed in the first region of ground-engaging surface, and the third segment is formed along a second side surface.

Clause 13: The sole structure of Clause 11, further comprising a second channel defined by a second plurality of segments including a fourth segment extending from a seventh node to an eighth node along a fourth axis substantially parallel to the first axis and a fifth segment extending from a ninth node to a tenth node along a fifth axis substantially parallel to the second axis.

Clause 14: The sole structure of Clause 13, wherein the first channel is formed only in the main body of the sole structure and the second channel is formed only in the insert of the sole structure.

Clause 15: The sole structure of Clause 14, wherein the insert includes an aperture through at least one of the nodes of the channel, the main body being exposed through the aperture.

Clause 16: The sole structure of Clause 13, wherein a first portion of the first channel is formed in the main body and a second portion of the first channel is formed in the insert.

Clause 17: The sole structure of Clause 13, wherein at least one of the segments includes an intermediate node.

Clause 18: The sole structure of Clause 17 wherein widths of each of the first channel and the second channel is variable in a direction along at least one of the axes.

Clause 19: The sole structure of Clause 11, wherein the second node and the third node define a first common node and the fourth node and the fifth node define a second common node, such that the first segment, the second segment, and the third segment are serially connected.

Clause 20: The sole structure of Clause 11, wherein the second node, the third node, and the fifth node define a common node such that the second segment and the third segment define first and second sub-channels, respectively.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a main body formed of a first material and defining a first region of a ground-engaging surface including a first channel defined by a first plurality of segments (i) extending between a lateral side and a medial side of the sole structure, (ii) being serially end-to-end arranged, (iii) being arranged at alternating angles to each other, and (iv) including at least one segment having sidewalls that provide the at least one segment with a first width along a length of the at least one segment, the first plurality of segments including a first segment extending along a first segment axis, a second segment extending along a second segment axis disposed at an oblique angle with respect to the first segment axis, and a third segment extending along a third segment axis that is oblique to the second segment axis; and at least one insert received by the main body, forming a second region of the ground-engaging surface, and including a second channel defined by a second plurality of segments, the second plurality of segments including a fourth segment extending substantially parallel to the first segment, a fifth segment extending substantially parallel to the second segment, and a sixth segment extending substantially parallel to the third segment.

2. The sole structure of claim 1, wherein at least one segment of the second plurality of segments includes sidewalls that provide the at least one segment of the second plurality of segments with a second width along a length of the at least one segment of the second plurality of segments.

3. The sole structure of claim 1, wherein the at least one insert comprises a second material, the second material being different than the first material.

4. The sole structure of claim 1, wherein the at least one insert is flush with the first region of the ground-engaging surface.

5. The sole structure of claim 1, wherein the at least one insert includes an anterior insert defining at least a portion of a forefoot region of the ground-engaging surface, and a posterior insert defining at least a portion of a heel region of the ground-engaging surface.

6. The sole structure of claim 5, wherein the main body defines at least a portion of a midfoot region of the sole structure and separates the anterior insert from the posterior insert.

7. The sole structure of claim 1, wherein the main body is formed of a foam material and the at least one insert is formed of a rubber material.

8. The sole structure of claim 1, wherein the main body further defines at least one side surface of the sole structure, a portion of the first channel of the main body extending along the side surface.

9. The sole structure of claim 8, wherein the at least one side surface of the sole structure includes a lateral side surface having a first portion of the first channel formed therein and a medial side surface having a second portion of the first channel formed therein.

10. An article of footwear incorporating the sole structure of claim 1.

11. A sole structure for an article of footwear, the sole structure comprising:

a main body formed of a first material and defining a first region of a ground-engaging surface including a first channel defined by a first plurality of segments (i) extending between a lateral side and a medial side of the sole structure, (ii) being serially end-to-end arranged, (iii) being arranged at alternating angles to each other, and (iv) including at least one segment having sidewalls that provide the at least one segment with a first width along a length of the at least one segment, the first plurality of segments including a first segment extending along a first segment axis, a second segment extending along a second segment axis disposed at an oblique angle with respect to the first segment axis, and a third segment extending along a third segment axis that is oblique to the second segment axis; and at least one insert received by the main body, forming a second region of the ground-engaging surface, and including a second channel defined by a second plurality of segments, at least one segment of the second plurality of segments (i) having sidewalls that provide the at least one segment of the second plurality of segments with a second width along a length of the at least one segment of the second plurality of segments and (ii) opposing the at least one segment of the first plurality of segments.

12. The sole structure of claim 11, wherein the at least one segment of the second plurality of segments is substantially parallel to the at least one segment of the first plurality of segments.

13. The sole structure of claim 11, wherein the at least one insert comprises a second material, the second material being different than the first material.

14. The sole structure of claim 11, wherein the at least one insert is flush with the first region of the ground-engaging surface.

15. The sole structure of claim 11, wherein the at least one insert includes an anterior insert defining at least a portion of a forefoot region of the ground-engaging surface, and a posterior insert defining at least a portion of a heel region of the ground-engaging surface.

16. The sole structure of claim 15, wherein the main body defines at least a portion of a midfoot region of the sole structure and separates the anterior insert from the posterior insert.

17. The sole structure of claim 11, wherein the main body is formed of a foam material and the at least one insert is formed of a rubber material.

18. The sole structure of claim 11, wherein the main body further defines at least one side surface of the sole structure, a portion of the first channel of the main body extending along the side surface.

19. The sole structure of claim 18, wherein the at least one side surface of the sole structure includes a lateral side surface having a first portion of the first channel formed therein and a medial side surface having a second portion of the first channel formed therein.

20. An article of footwear incorporating the sole structure of claim 11.

* * * * *